US010668610B2

(12) United States Patent
King, Jr.

(10) Patent No.: US 10,668,610 B2
(45) Date of Patent: Jun. 2, 2020

(54) METHODS AND APPARATUS FOR A CHIPPING HAMMER ADAPTER HANDLE

(71) Applicant: Skitter & Squirt Adventures, LLC, Missoula, MT (US)

(72) Inventor: Jack M. King, Jr., Phoenix, AZ (US)

( * ) Notice: Subject to any disclaimer, the term of this patent is extended or adjusted under 35 U.S.C. 154(b) by 0 days.

(21) Appl. No.: 16/216,024

(22) Filed: Dec. 11, 2018

(65) Prior Publication Data

US 2019/0321959 A1 Oct. 24, 2019

Related U.S. Application Data

(63) Continuation-in-part of application No. 15/961,286, filed on Apr. 24, 2018.

(51) Int. Cl.

| | |
|---|---|
| ***B25D 17/04*** | (2006.01) |
| ***E01C 23/12*** | (2006.01) |
| ***E04G 23/00*** | (2006.01) |
| ***B25F 5/00*** | (2006.01) |
| ***B25D 17/28*** | (2006.01) |

(52) U.S. Cl.

CPC ..... *B25D 17/04* (2013.01); *B25D 17/28* (2013.01); *B25F 5/006* (2013.01); *E01C 23/124* (2013.01); *E04G 23/006* (2013.01); *B25D 2217/0057* (2013.01); *B25D 2217/0073* (2013.01); *B25D 2222/03* (2013.01); *B25D 2250/041* (2013.01)

(58) Field of Classification Search

CPC ..... E04G 23/006; B25D 17/04; B25D 17/28; B25D 17/32; B25D 17/043; Y10T 16/4719; Y10T 16/469; Y10T 16/4713; B25F 5/00; B25F 5/02; B24B 23/005; E01C 23/124

USPC ..... 299/36.1, 37.1, 37.3, 37.4

See application file for complete search history.

(56) References Cited

U.S. PATENT DOCUMENTS

| | | | | |
|---|---|---|---|---|
| 2,465,192 | A * | 3/1949 | Booth | E04G 23/006 15/93.1 |
| 4,009,908 | A * | 3/1977 | Alinder | E04G 23/006 15/93.1 |
| 5,538,210 | A * | 7/1996 | Ohmori | F16L 3/04 248/222.12 |
| 6,021,854 | A | 2/2000 | Scarola | |
| 6,786,556 | B2 * | 9/2004 | Due | B24B 7/186 299/36.1 |
| 9,844,868 | B1 * | 12/2017 | Abbey | B25D 17/32 |

(Continued)

OTHER PUBLICATIONS

Bosco, LLC, Product—HHDA HandHeld Demolition Assistant, http://boscotool.com/product-hhda.html.

*Primary Examiner* — David J Bagnell
*Assistant Examiner* — Michael A Goodwin
(74) *Attorney, Agent, or Firm* — Lisa Foundation Patent Law Clinic at Arizona State University

(57) ABSTRACT

Methods and apparatus for a chipping hammer adapter handle generally comprising an elongated shaft and a hammer receiver. The elongated shaft is coupled to the hammer receiver. The hammer receiver comprises a hammer handle housing configured to receive a chipping hammer handle, and at least one secure arm to secure a chipping hammer. The adapter handle further comprises a knee guard and at least one vacuum hose guide. The adapter handle allows a user to remain in a standing position while using a chipping hammer for tile removal. The more ergonomic position may prevent fatigue and health issues for the user.

19 Claims, 35 Drawing Sheets

(56) References Cited

U.S. PATENT DOCUMENTS

| | | | | |
|---|---|---|---|---|
| 2007/0228805 | A1* | 10/2007 | Due | E01C 23/124 299/37.1 |
| 2008/0202264 | A1* | 8/2008 | Howland | B25F 5/00 74/156 |
| 2010/0059949 | A1 | 3/2010 | Kennard | |
| 2010/0233938 | A1* | 9/2010 | Brunner | B24B 23/005 451/28 |
| 2012/0260456 | A1* | 10/2012 | King, Jr. | B23D 59/006 15/362 |
| 2012/0260458 | A1* | 10/2012 | King, Jr. | A47L 7/0095 15/415.1 |
| 2016/0136799 | A1 | 5/2016 | Morissette et al. | |
| 2016/0288478 | A1* | 10/2016 | Rodriguez | B32B 43/006 |
| 2017/0138072 | A1* | 5/2017 | Tailly | E04G 23/006 |
| 2018/0085907 | A1* | 3/2018 | Wilson | B25D 17/32 |
| 2018/0111203 | A1* | 4/2018 | Moore | B23B 45/003 |

* cited by examiner

METHODS AND APPARATUS FOR A CHIPPING HAMMER ADAPTER HANDLE

CROSS REFERENCE TO RELATED APPLICATIONS

This application is a continuation-in-part of application Ser. No. 15/961,286, filed 24 Apr. 2018.

BACKGROUND OF INVENTION

1. Technical Field

Aspects of this document relate generally to systems and methods for using a chipping hammer while the user remains in an ergonomic standing position.

2. Description of Related Art

Chipping hammers are commonly used when performing tile removal. These tools can be heavy and difficult for a user to maneuver when removing tile. In addition, individuals using a chipping hammer to remove tile are frequently required to kneel or squat in an uncomfortable position so that they can effectively utilize the tool. Over time, this can cause fatigue and health issues.

The difficulty of using power tools for tile removal has been felt across the industry. As such, there has been a development of adapters that allow a user to stand while operating the power tool. Current developments have been primarily focused with the use of jackhammers, however, there have been some developments in the field with chipping hammers.

So as to reduce the complexity and length of the Detailed Specification, and to fully establish the state of the art in certain areas of technology, Applicant herein expressly incorporates by reference all of the following materials identified in each numbered paragraph below.

U.S. Pat. No. 6,021,854 discloses an adapter handle for a power tool, which allows the operator to operate the power tool from a standing erect position. The adapter handle comprises an elongated longitudinal handle with securing members affixed thereto and dimensioned and designed to be secured to the power tool.

U.S. Patent Publication No. 2010/0059949 discloses a jackhammer trolley comprising a mainframe member with a clamp member at the bottom end, a base frame member removably attached to the mainframe member by pivoting joints with at least one wheel member removably attached to its bottom, a handle having a hand lever attached to said top end, and at least one vibration dampener fixed to said top or bottom end of the mainframe member.

U.S. Patent Publication No. 2016/0136799 discloses a self-adjusting handheld ergonomic holder for jackhammer for manual use by an operator in chipping hardened ground surface along a continuously variable chipping strike angle.

Handheld Demolition Assistant. Referenced for background information. This product is an attachment for demolition hammers that broadly allows a user to stand while operating a demolition hammer.

SUMMARY OF THE INVENTION

The present disclosure provides among other things an adapter handle for a chipping hammer. The adapter handle includes a hammer receiver coupled to an elongated shaft at one end of the elongated shaft. The hammer receiver includes a hammer handle housing configured to receive a chipping hammer handle. The hammer handle housing may have two segments which are coupled together about a pivot point to dampen vibrations. The adapter handle may be comprised of at least one of a nylon, a plastic, a molded rubber, a machined rubber, or a urethane to dampen vibrations. A shaft receiver is coupled to the hammer handle housing. The shaft receiver comprises a hollow substantially cylindrical channel having an opening that is configured to receive the elongated shaft. One or more secure arms are coupled to the hammer receiver. A secure arm secures the chipping hammer. An end grip is coupled to the elongated shaft at the end of the elongated shaft opposite the hammer receiver. The adapter handle includes one or more vacuum hose guides configured to secure a vacuum hose. The adapter handle includes a knee guard.

In some embodiments the elongated shaft may be telescopic comprising an inner portion and an outer portion. The inner portion may comprise a plurality of shaft openings and the outer portion may have two lock openings. This embodiment may also comprise a locking pin that is configured to pass through two of the openings among the plurality of shaft openings and the two lock openings. This embodiment enables the elongated shaft to have an adjustable length.

In some embodiments a mid-grip may extend substantially perpendicularly from the elongated shaft.

In some embodiments the end grip may comprise a T-shaped handle.

In some embodiments the hollow substantially cylindrical channel of the shaft receiver may further comprise two receiver shaft pin openings. The elongated shaft may comprise two shaft pin openings. This embodiment may also comprise a shaft pin that is configured to pass through the two receiver shaft pin openings and the two shaft pin openings to further secure the hammer receiver to the elongated shaft.

In some embodiments the hammer receiver may comprise a mount having a mount opening. This embodiment may have a knee guard comprising a clevis having a first knee guard opening. A plurality of supports may be coupled to the clevis to provide structural support to the clevis. The knee guard may comprise a securing pin that is configured to pass through the mount opening and the first knee guard opening to secure the knee guard to the hammer receiver and to allow the knee guard to pivot about an axis of the securing pin.

In some embodiments the mount may also comprise a guide channel and the knee guard may further comprise a second knee guard opening. The knee guard may further comprise a restriction pin that is configured to pass through the second knee guard opening and the guide channel to restrict the pivotal range of the knee guard.

In some embodiments each secure arm may have a first end and a second end. The first end of each secure arm may be rotatably coupled to the hammer receiver. A locking latch may be coupled to the second end of a secure arm. A corresponding lock anchor may be coupled to the second end of a second secure arm.

In some embodiments the hammer receiver may comprise one or more cable guides that direct a chipping hammer power cable from the chipping hammer alongside the elongated shaft.

In some nonlimiting embodiments a pivot point between two segments of the hammer handle housing may be effectuated by a ball bearing, spring, rotary damper, rubber grommet, or rubber plate. In some embodiments a pivot point effectuated by a spring may further comprise a leaf spring, tensile spring, or torsion spring. In other embodiments a pivot point effectuated by a ball bearing may further comprises a spring retainer. It will be apparent to a person having ordinary skill in the art that a variety of technique may be reasonably employed to dampen vibration with a pivot point.

In other embodiments a pivot point is unnecessary because the adapter handle is comprised primarily of at least one of a nylon, a plastic, a molded rubber, a machined rubber, a urethane, or another suitably flexible material which innately dampens vibrations.

In some nonlimiting embodiments two additional vacuum hose guides may be rotatably coupled to the elongated shaft proximal to the end grip.

Tile may be removed by gripping the end grip of the adapter handle and moving the end grip such that the coupled chipping hammer traverses a tiled surface, the blade of the chipping hammer contacting the tiled surface, thereby removing tile.

Pressure may be exerted on the knee guard to apply additional force to the adapter handle, thereby removing tile more effectively.

The height of the adapter handle may be adjusted by adjusting the length of a telescoping elongated shaft.

The adapter handle may be gripped from a standing position.

The mid-grip may be gripped for increased control of the adapter handle.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographers, to use only the plain and ordinary meaning of terms in the specification and claims unless he clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of post-AIA 35 U.S.C. § 112(f). Thus, the use of the words "function," "means" or "step" in the Detailed Description or Description of the Drawings or claims is not intended to somehow indicate a desire to invoke the special provisions of post-AIA 35 U.S.C. § 112(f), to define the invention. To the contrary, if the provisions of post-AIA 35 U.S.C. § 112(f) are sought to be invoked to define the inventions, the claims will specifically and expressly state the exact phrases "means for" or "step for, and will also recite the word "function" (i.e., will state "means for performing the function of [insert function] "), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventor not to invoke the provisions of post-AIA 35 U.S.C. § 112(f). Moreover, even if the provisions of post-AIA 35 U.S.C. § 112(f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

In one application, a novel system for using a chipping hammer for floor tile removal while the user stands in an erect position is provided.

Figure 1:
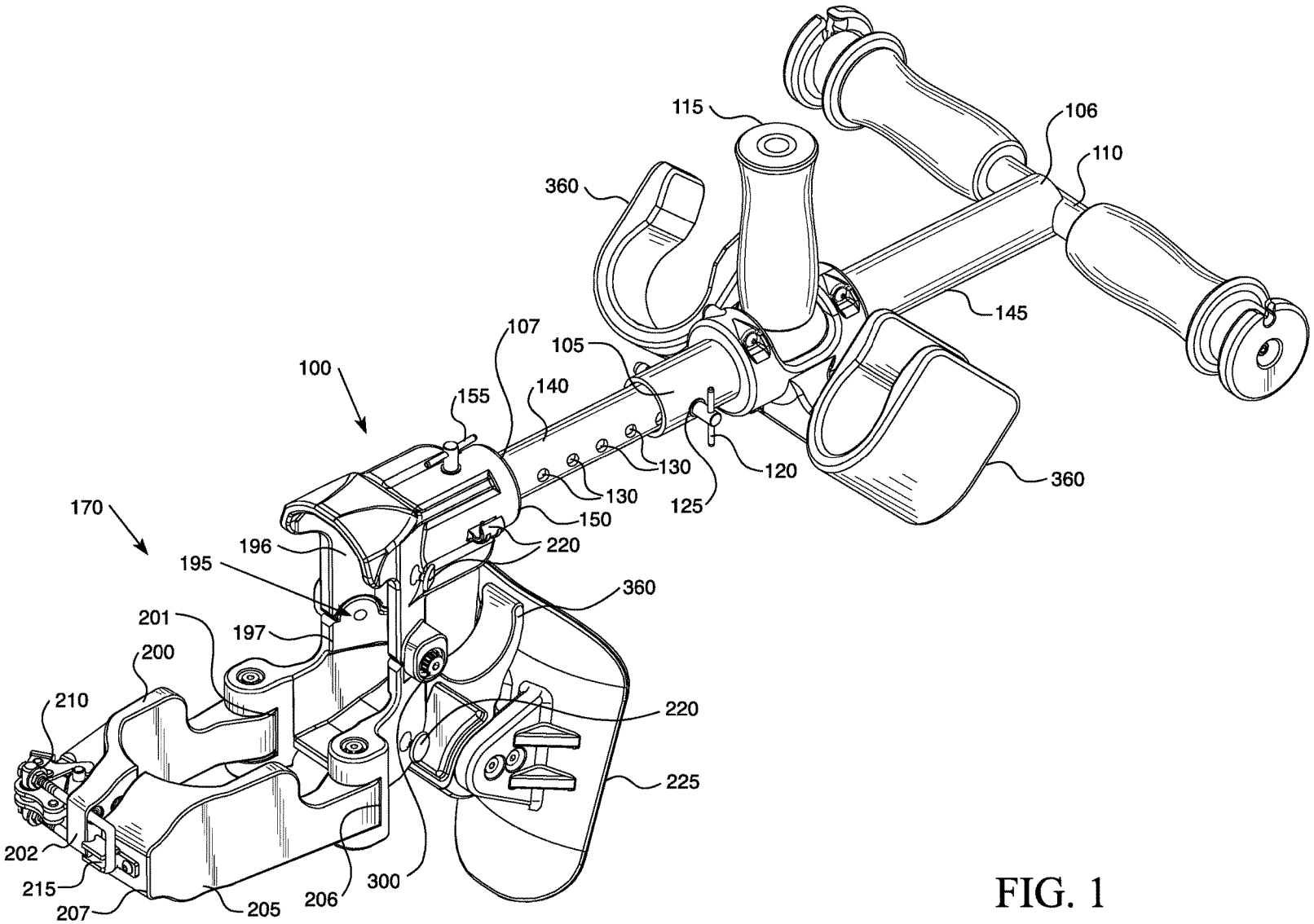
FIGS. 1 and 2 depict oblique views of an implementation of an adapter handle.
Figure 2:
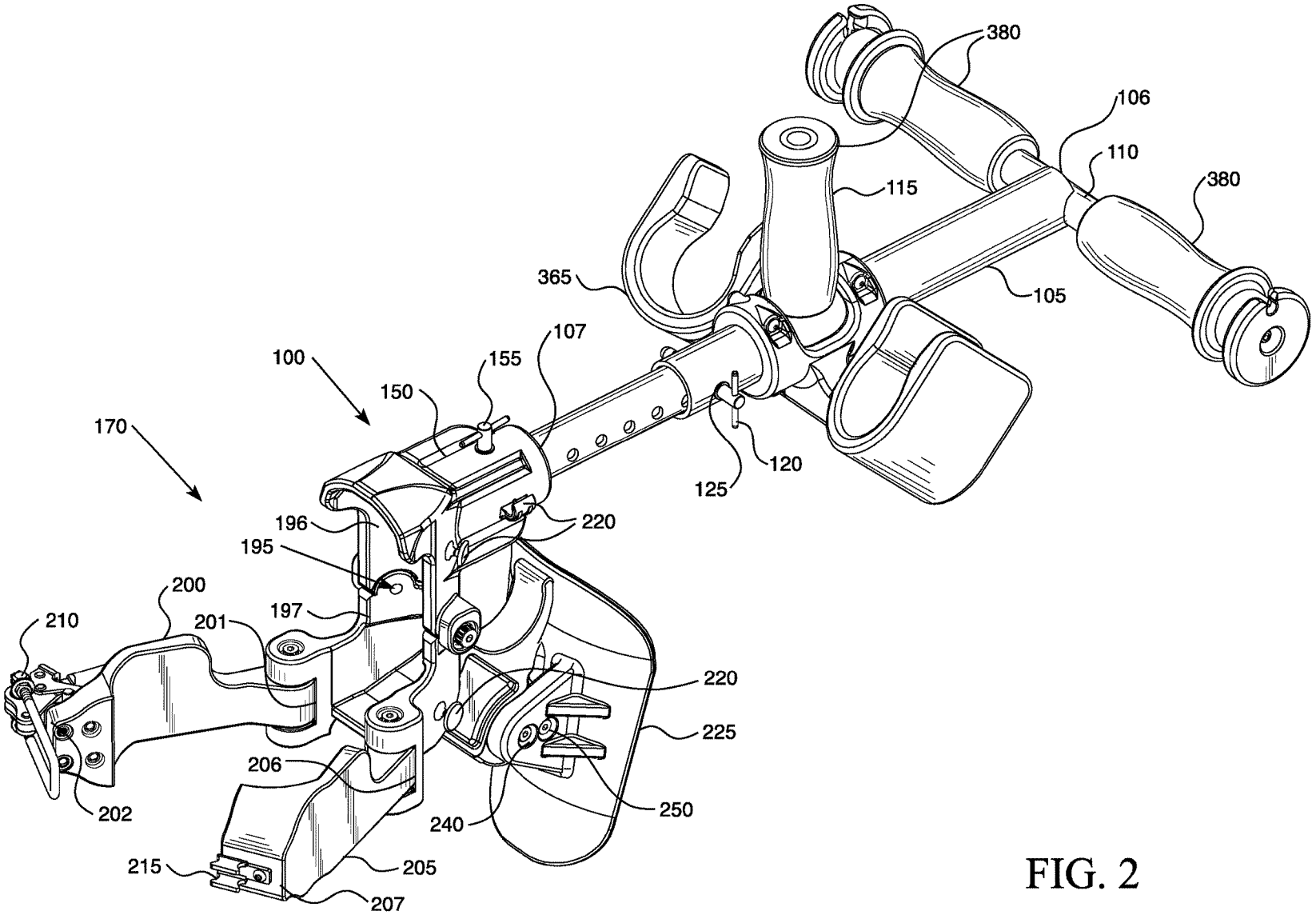
Figure 19:
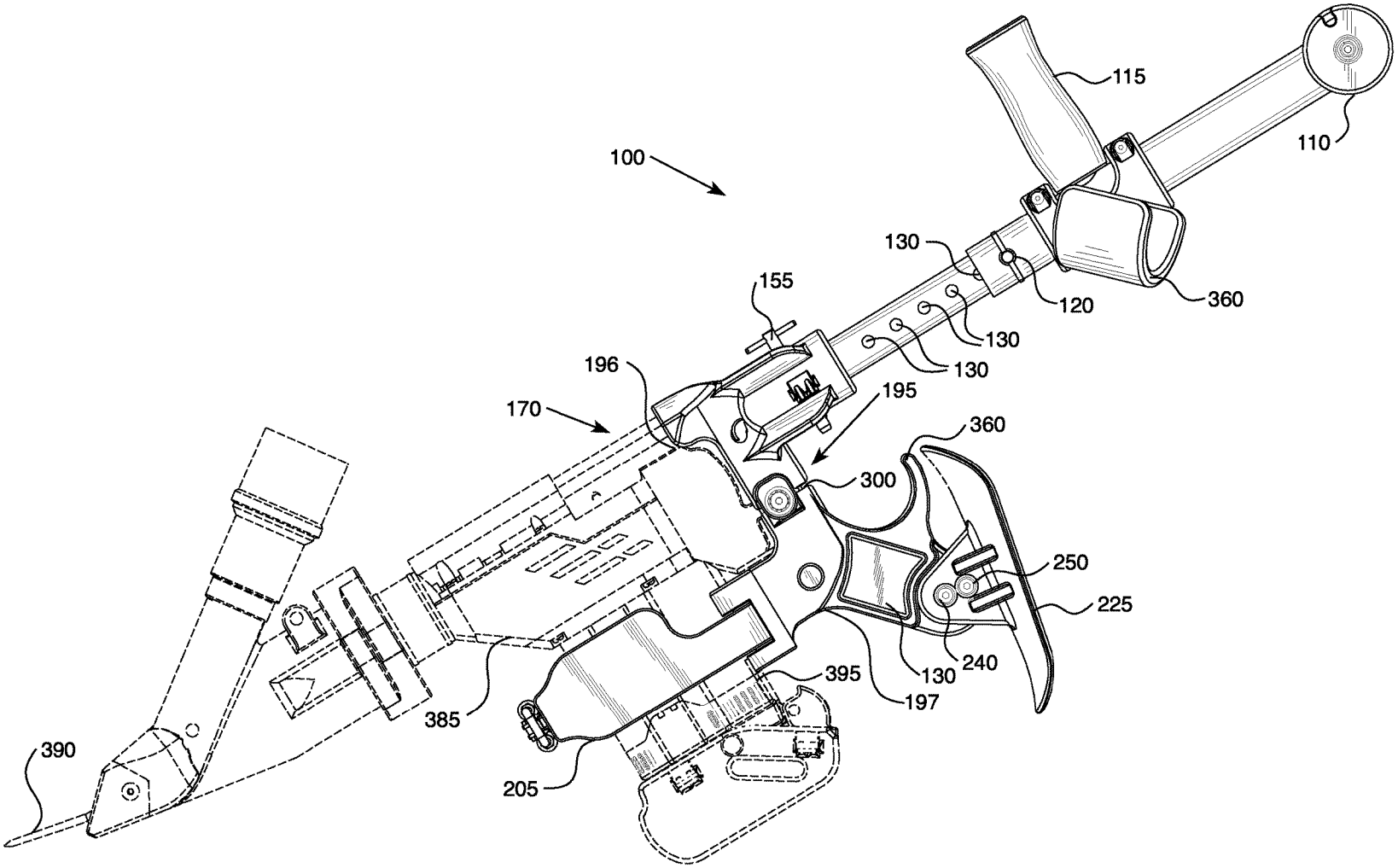
FIG. 19 depicts an oblique side view of an implementation of an adapter handle.
Figure 20:
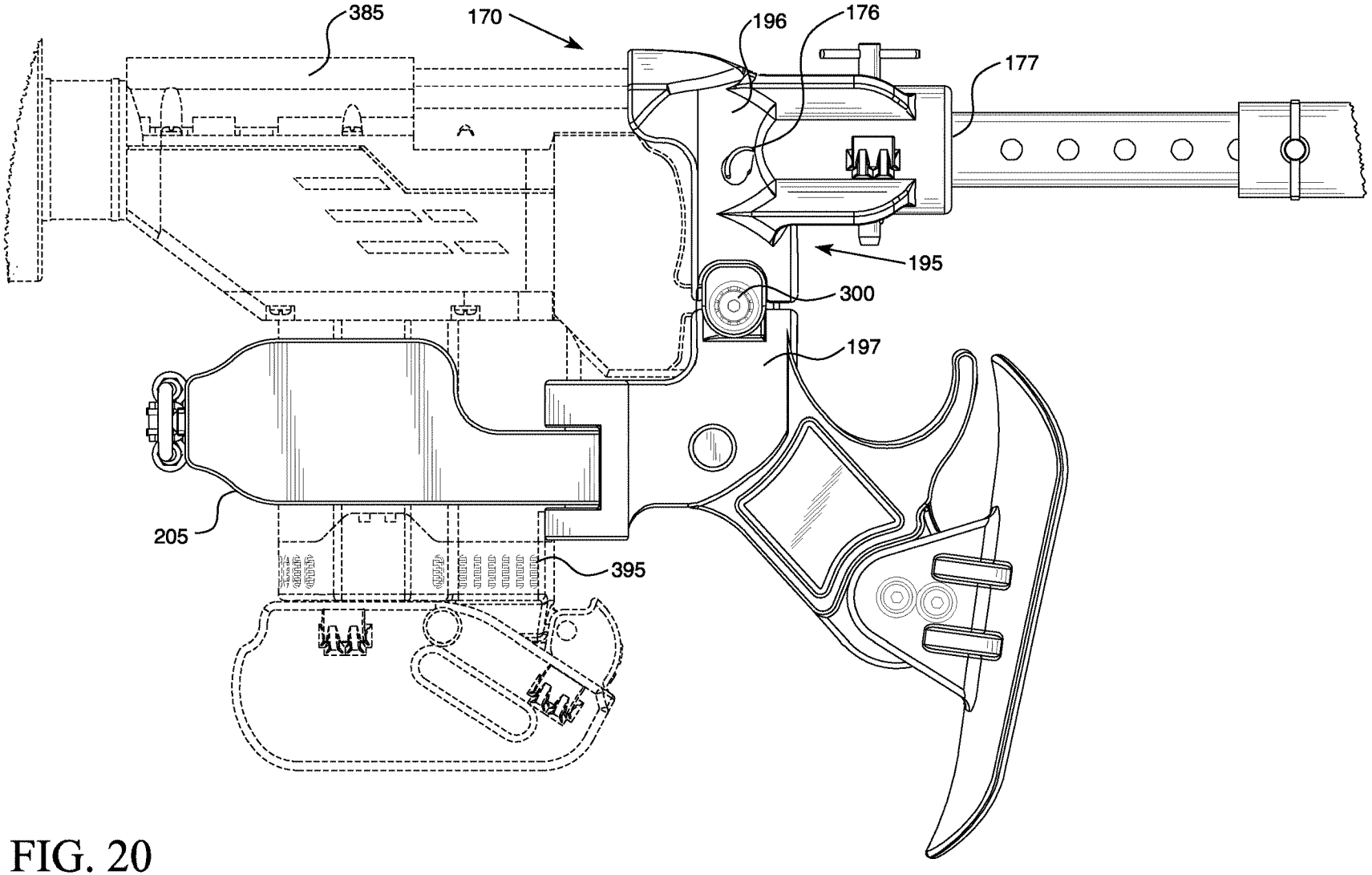
FIG. 20 depicts a side view of an implementation of an adapter handle.
Figure 22:
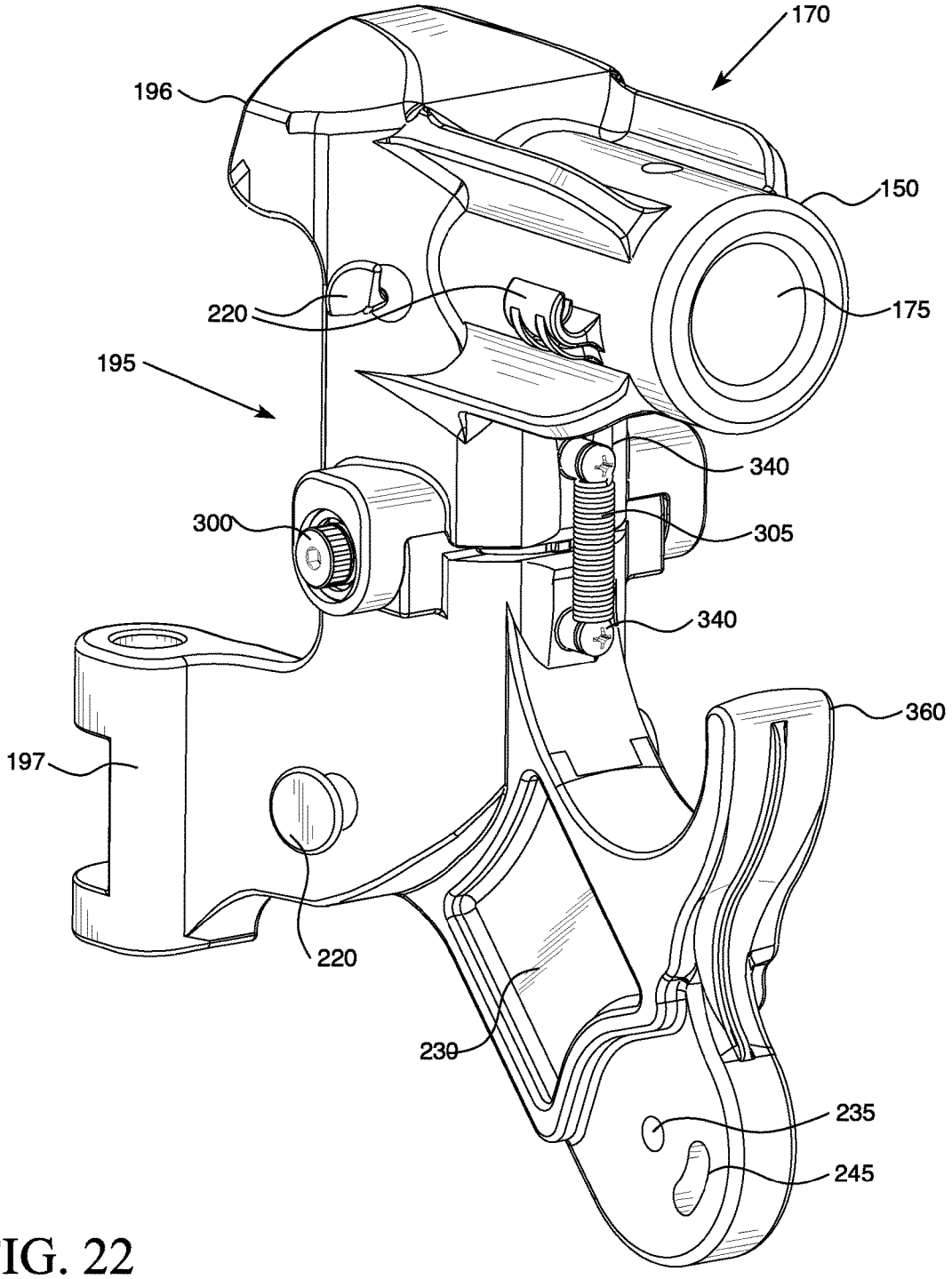
Figure 23:
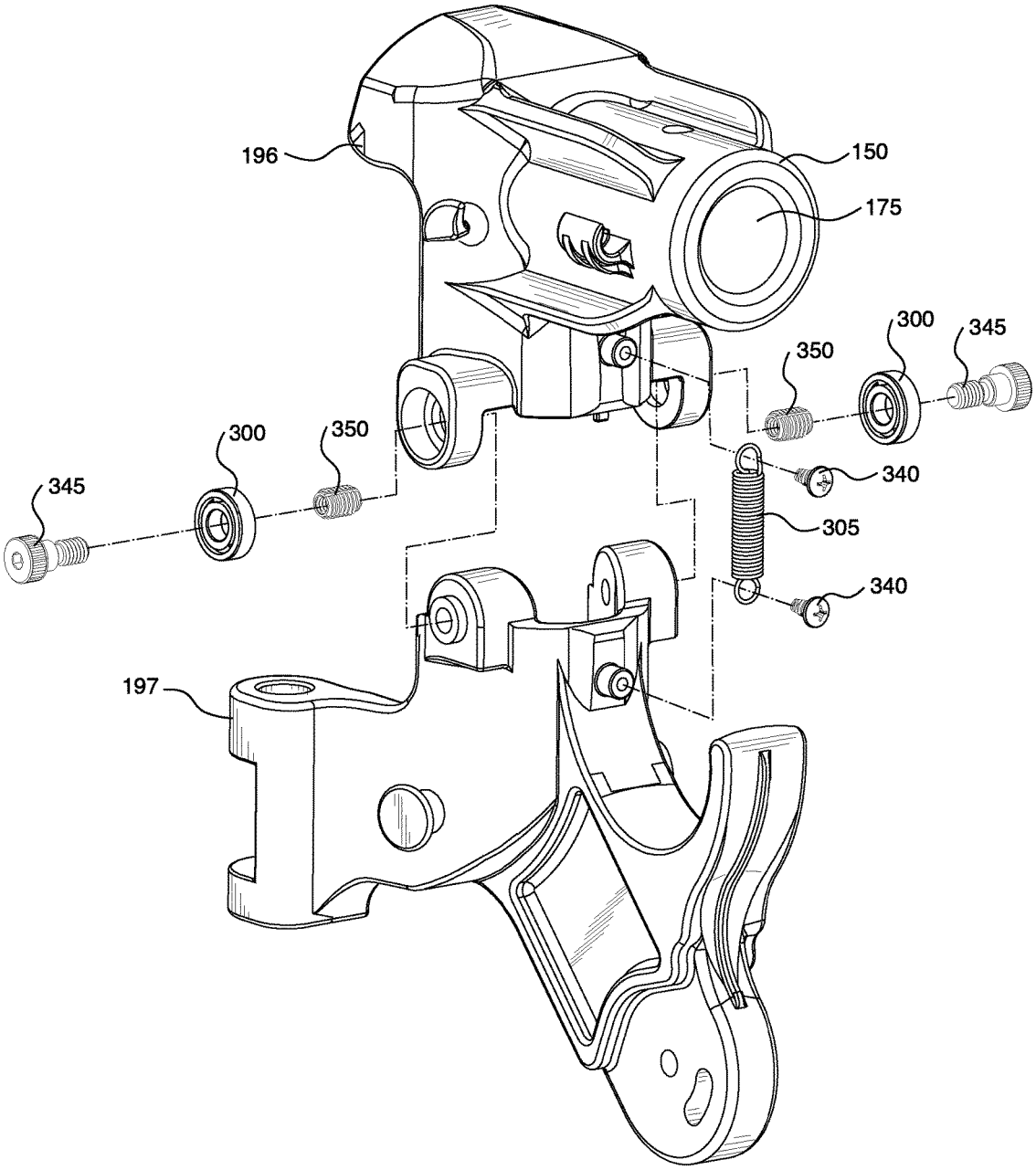
FIG. 23 depicts an exploded oblique rear view of a hammer receiver.
Figure 27:
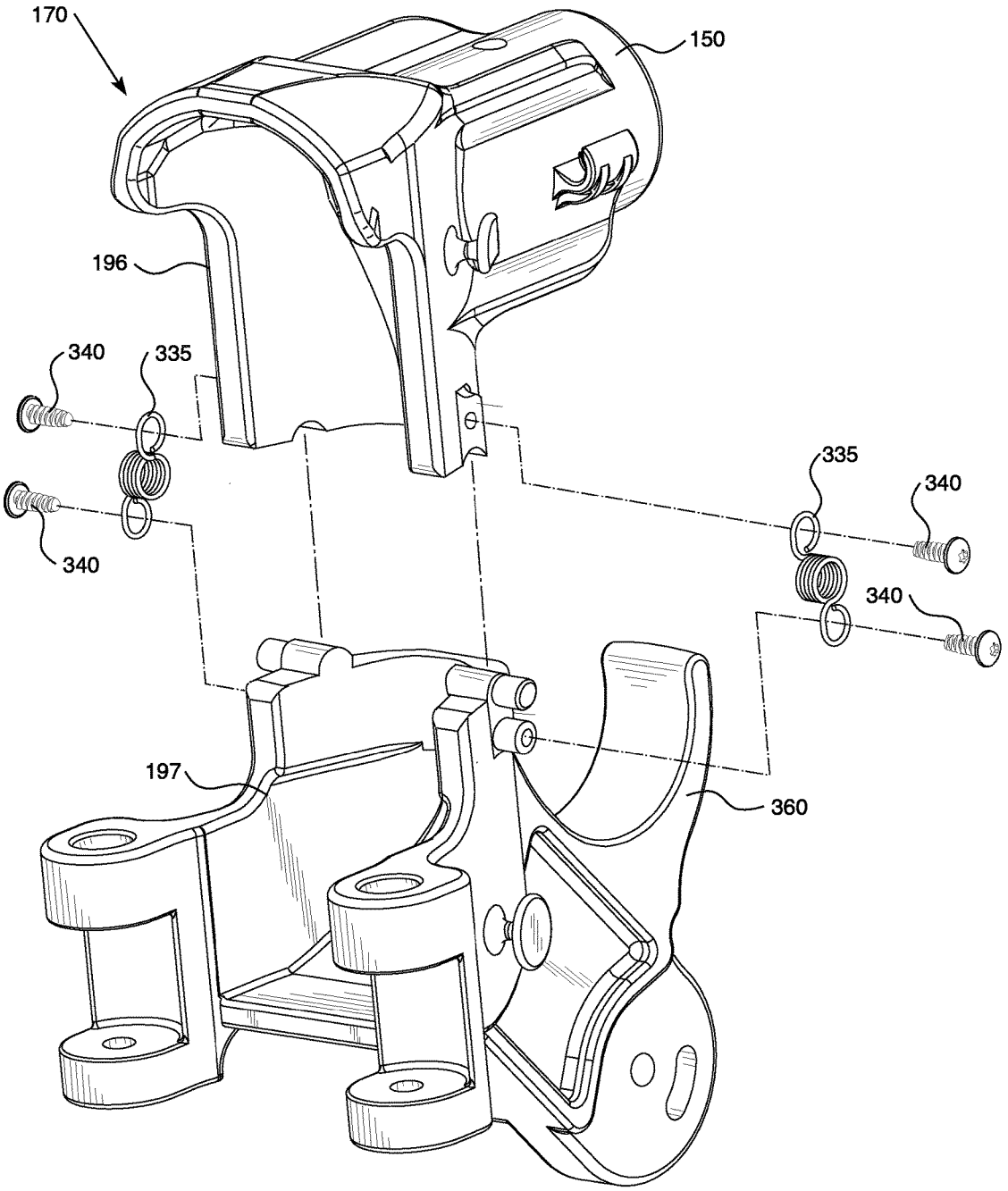
Figure 28:
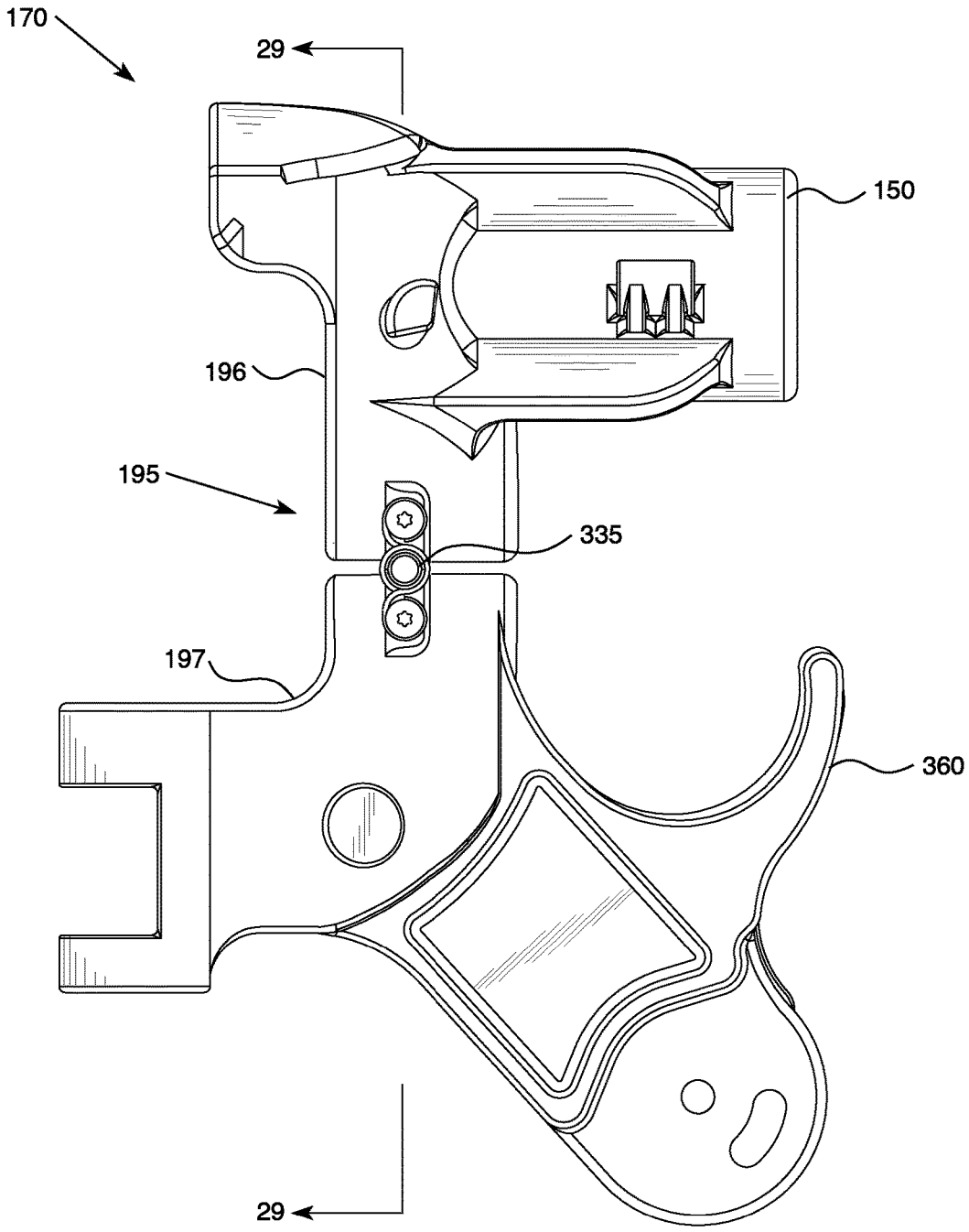
Figure 29:
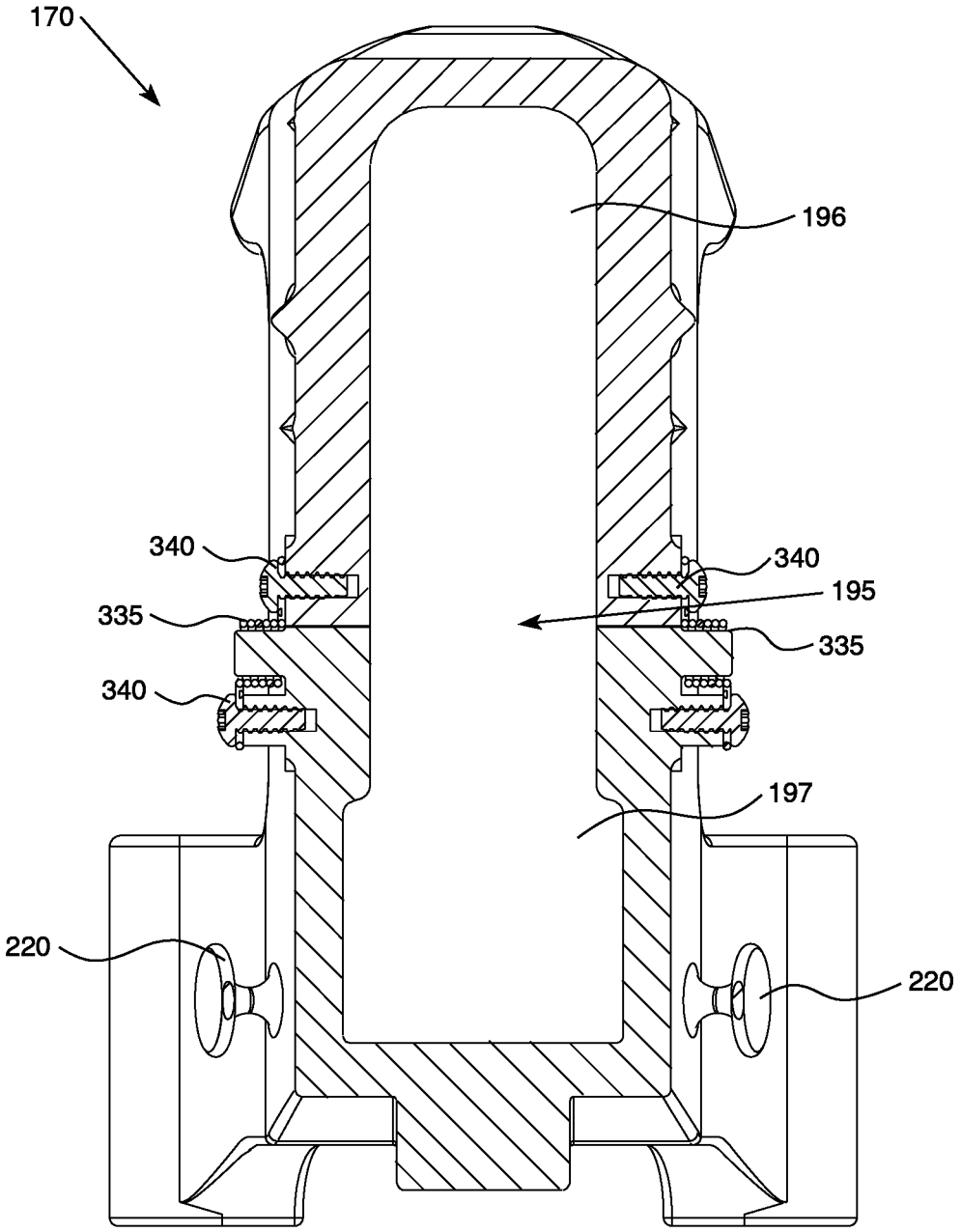
FIGS. 29, 32, 35, and 38 depict cross-sectional top views of hammer receivers.
Figure 31:
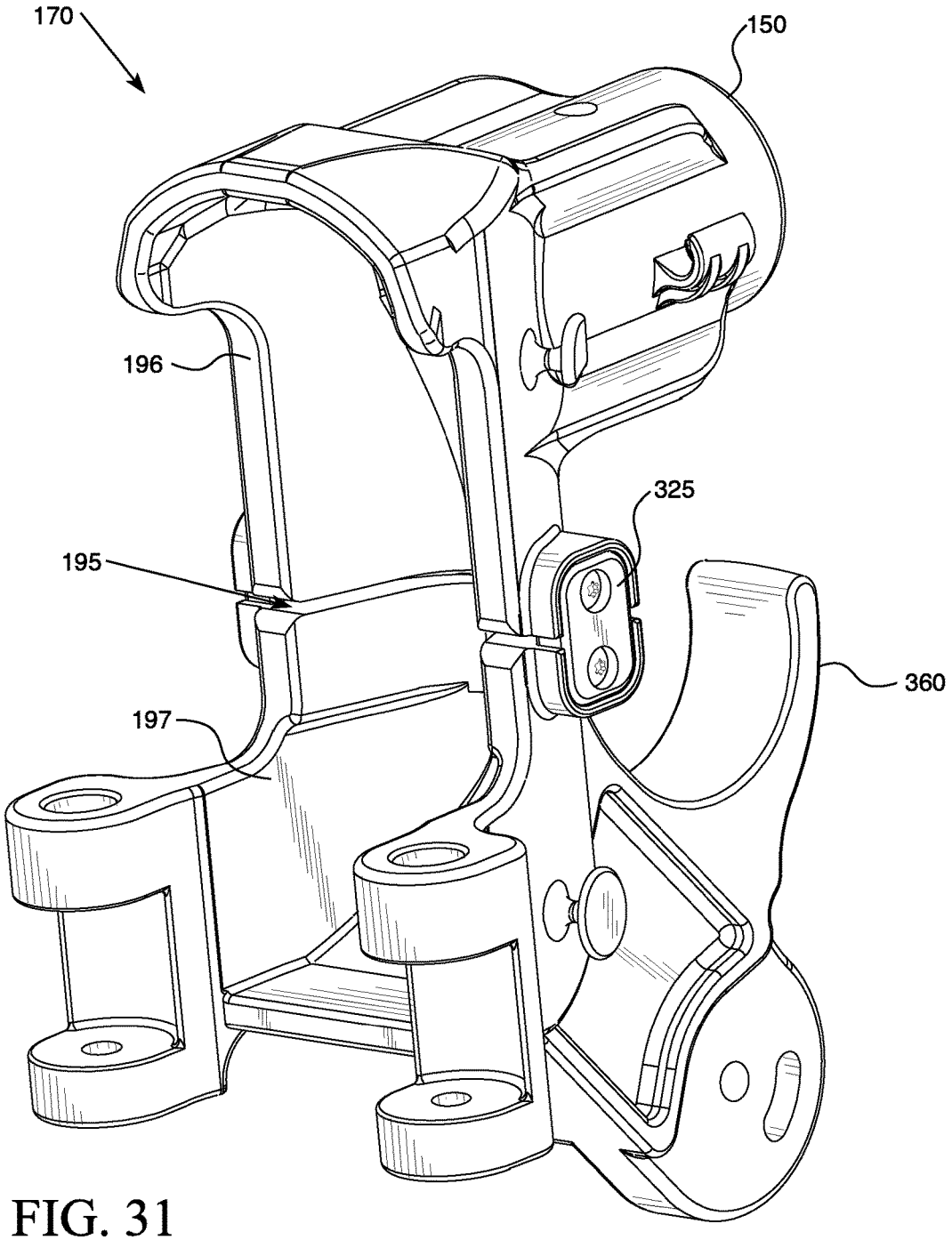
Figure 32:
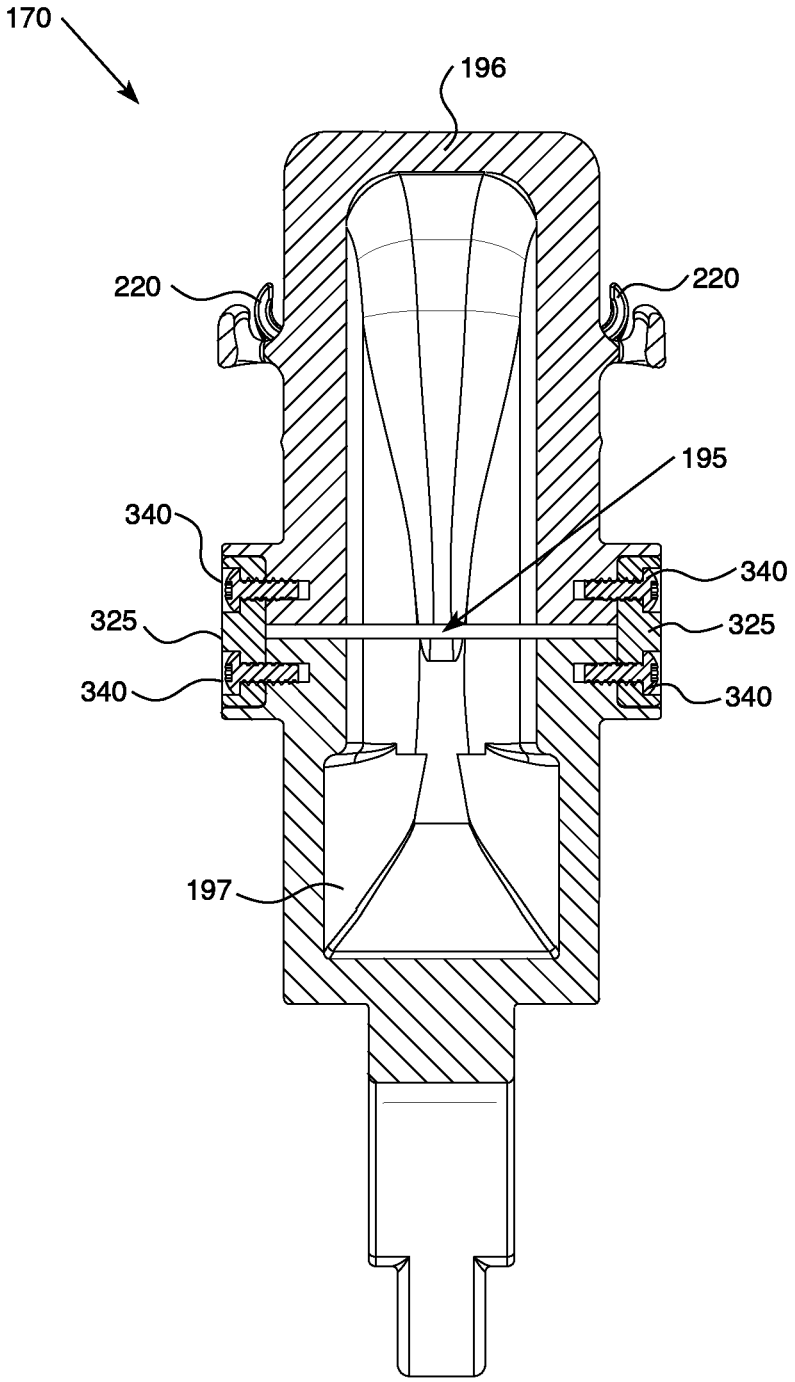

FIGS. 1 and 2 illustrate an exemplary embodiment of an adapter handle 100 for a chipping hammer 385 (FIGS. 19 and 20). In this nonlimiting embodiment, the adapter handle 100 comprises an elongated shaft 105, having a first end 106 and a second end 107, a hammer receiver 170 configured to receive a chipping hammer 385 (FIGS. 19 and 20), and an end grip 110 which may be gripped to move and control the adapter handle 100. The end grip 110 is coupled to the first end of the elongated shaft 106. The elongated shaft 105 may be telescopic, allowing a height of the adapter handle 100 to be adjusted by adjusting a length of the elongated shaft 105, having an inner portion 140 and an outer portion 145. The inner portion 140 of the elongated shaft 105 may comprise a plurality of shaft openings 130. A locking pin 120 may be configured to pass through two openings from among the plurality of shaft openings 130 and two lock openings 125 (FIG. H) to lock the height of the adapter handle 100 prior to use. A mid-grip 115 extends from the outer portion of the elongated shaft 145, substantially perpendicular to the length of the elongated shaft 105. The mid-grip 115 may be gripped for increased control of the adapter handle 100. The additional grip provides a user with additional options for applying a net force to the adapter handle 100 in a tile removal process. The end grip 110 may be comprised of a T-shaped handle. The hammer receiver 170 is coupled to the elongated shaft 105 at the second end of the elongated shaft 107. The hammer receiver 170 comprises a hammer handle housing 195 against which a chipping hammer handle 395 (FIGS. 19 and 20) fits snugly. The hammer handle housing 195 has a first housing segment 196 rotatably coupled to a second housing segment 197 about a pivot point to dampen vibrations. In the present nonlimiting embodiment, the pivot point is effectuated by a ball bearing 300. In other embodiments, the pivot point may be effectuated by a leaf spring 310 (FIGS. 24, 25, and 26), a rotary damper 315 (FIGS. 37, 38, and 39), a rubber grommet 320 (FIGS. 33, 34, 35, and 36), a rubber plate 325 (FIGS. 30, 31, and 32), a tensile spring 330 (FIGS. 40 and 41), or a torsion spring 335 (FIGS. 27, 28, and 29). In other embodiments, a pivot point effectuated by a ball bearing 300 may further comprise a spring retainer 305 (FIGS. 22 and 23). The first housing segment 196 is coupled to a shaft receiver 150. The shaft receiver 150 comprises a hollow substantially cylindrical channel 175 (FIG. 8) having a first end 176, the first end 176 coupled to the first housing segment 196, and a second end 177 comprising a receiver opening 165 configured to receive the second end of the elongated shaft 107. A knee guard 225 is coupled to the hammer receiver 170. Force may be applied to the knee guard 225, thereby removing tile more effectively. One or more cable guides 220 may be coupled to the hammer receiver. FIGS. 1 and 2 further illustrate a first secure arm 200, having a first end 201 and a second end 202, and a second secure arm 205, having a first end 206 and a second end 207. The first end of the first secure arm 201 and the first end of the second secure arm 206 may each be rotatably coupled to the hammer receiver 170 to facilitate securing a chipping hammer 385 where an exact size and an exact shape of the chipping hammer 385 may vary by a desired brand or a desired specific application. A locking latch 210 may be coupled to the second end of the first secure arm 202 and a corresponding lock anchor 215 may be coupled to the second end of the second secure arm 207 to allow the chipping hammer 385 to be secured to the hammer receiver 170 prior to use.

In other embodiments, the elongated shaft 105 may not be telescopic. It can be appreciated by those of ordinary skill in the art that the elongated shaft 105 can have multiple variations. Such variations may include non-telescopic handles, breakaway handles, angled handles, and others.

In some embodiments the end grip 110 may comprise a grip other than a T-shaped handle. It can be appreciated by those of ordinary skill in the art that the end grip 110 can have multiple variations. Such variations may include D-grips, Y-grips, L-grips, and others.

The end grip 110 may further comprise one or more foam grips 380. The mid-grip may further comprise a foam grip 380. The foam grips may provide additional comfort while operating the adapter handle 100.

In additional embodiments, the mid-grip 115 may not be desired. In those embodiments, the mid-grip 115 may be absent from the elongated shaft 105.

In other embodiments, the number of secure arms coupled to the hammer receiver 170 may vary. The secure arms are intended to secure a chipping hammer 385 to the hammer receiver 170. Alternative embodiments may accomplish this using a single secure arm. Conversely, other embodiments may use three or more secure arms to secure a chipping hammer 385 to the hammer receiver 170. In other embodiments, the secure arms may couple to the elongated shaft 105 rather than the hammer receiver 170.

Figure 3:
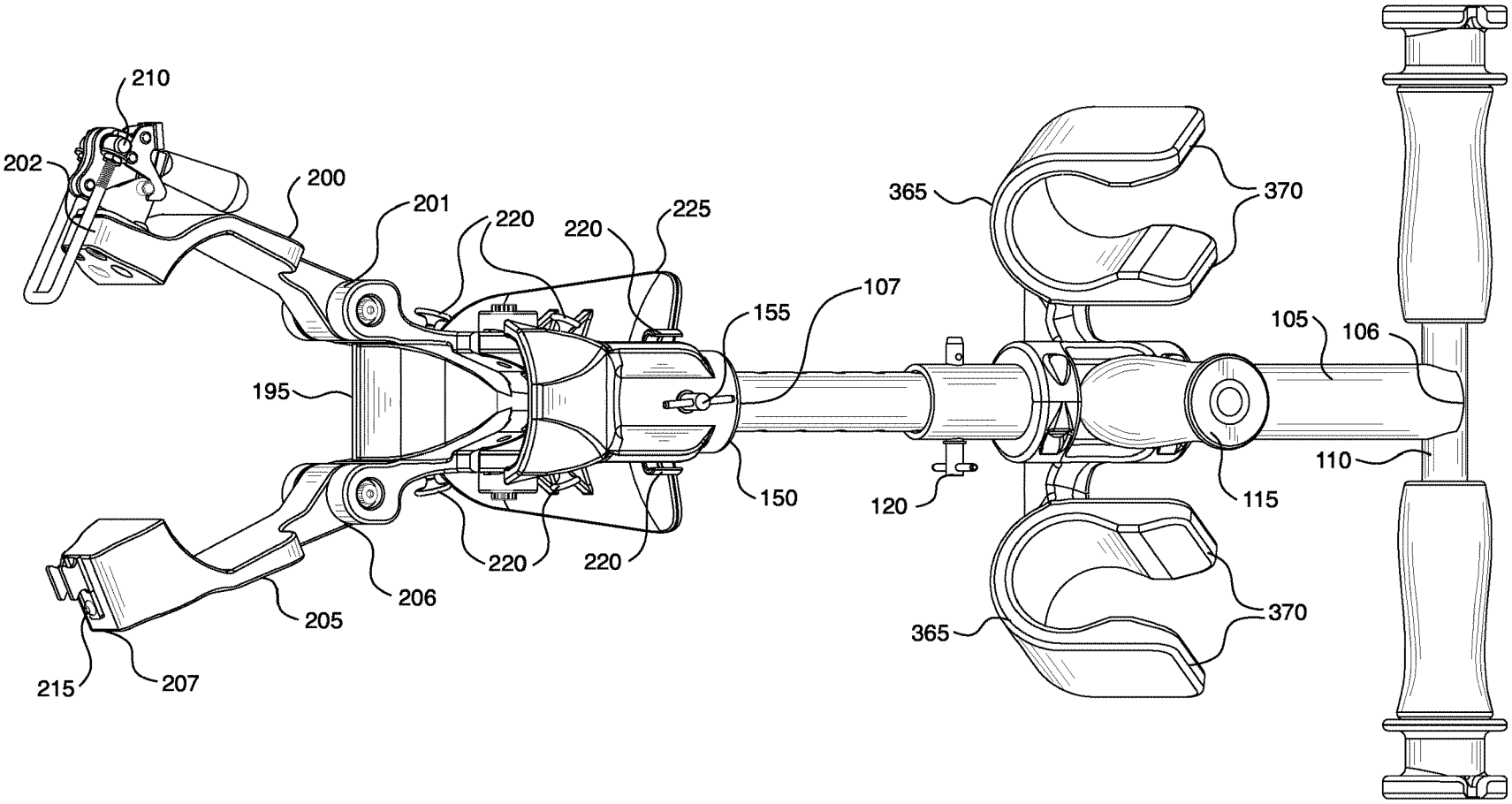
FIG. 3 depicts an oblique frontal view of an implementation of an adapter handle.
Figure 17:
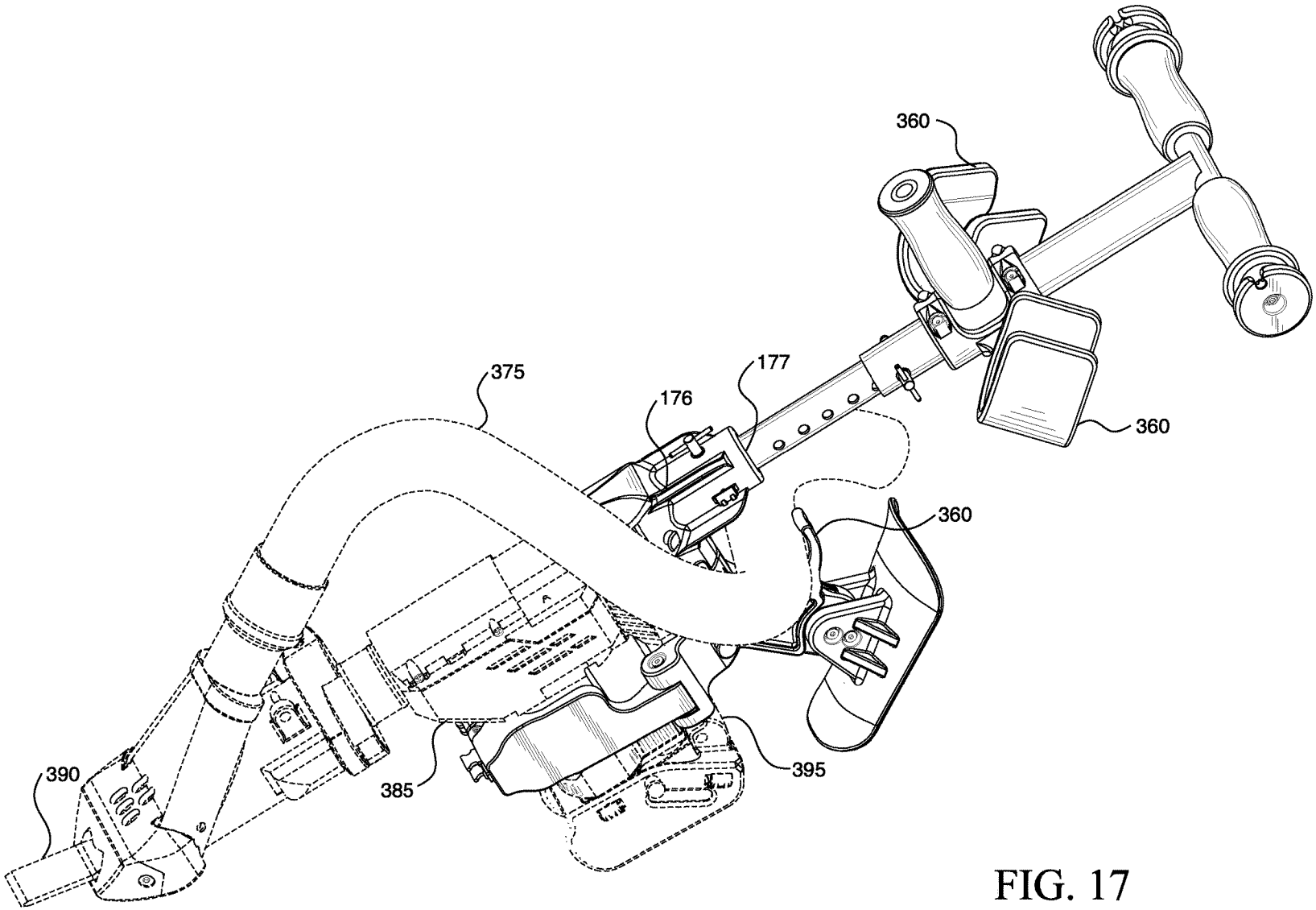
FIGS. 17 and 18 depict oblique views of an implementation of an adapter handle.

FIG. 3 illustrates an oblique frontal view of the same exemplary embodiment of an adapter handle 100 as illustrated in FIGS. 1 and 2. One or more vacuum hose guides 360 (FIG. 1) may be coupled to one of the elongated shaft 105 and the hammer receiver 170. The vacuum hose guide 360 comprises a substantially concave cradle 365 and may further comprise raised walls 370. A vacuum hose 375 (FIG. 18) may distort as it is passed through the raised walls 370 which are narrower than the vacuum hose 375. Pinching the hose slightly allows it to pass through and be held securely in place once it reaches the substantially concave cradle 365. The purpose of the vacuum hose 375 (FIG. 18) is to facilitate a dust free tile removal. One having ordinary skill in the art will appreciate the benefits of minimizing the amount of dust and other small debris released into the air during a tile removal process. These benefits include the following: (1) a homeowner with a health issue such as an allergy, an asthma, or another respiratory condition will not inhale potentially harmful dust particles, (2) a residence with a sensitive inhabitant such as an elder parent, a baby, a toddler, a child, or a pet will not be exposed to potentially harmful dust particles, (3) a vulnerable piece of property will not be damaged by dust and other small debris, and (4) cleanliness of a work area may be better maintained. FIG. 17 further illustrates a vacuum hose 375 secured in a vacuum hose guide 360 in another location compared to the vacuum hose guide 360 utilized in FIG. 18.

Figure 4:
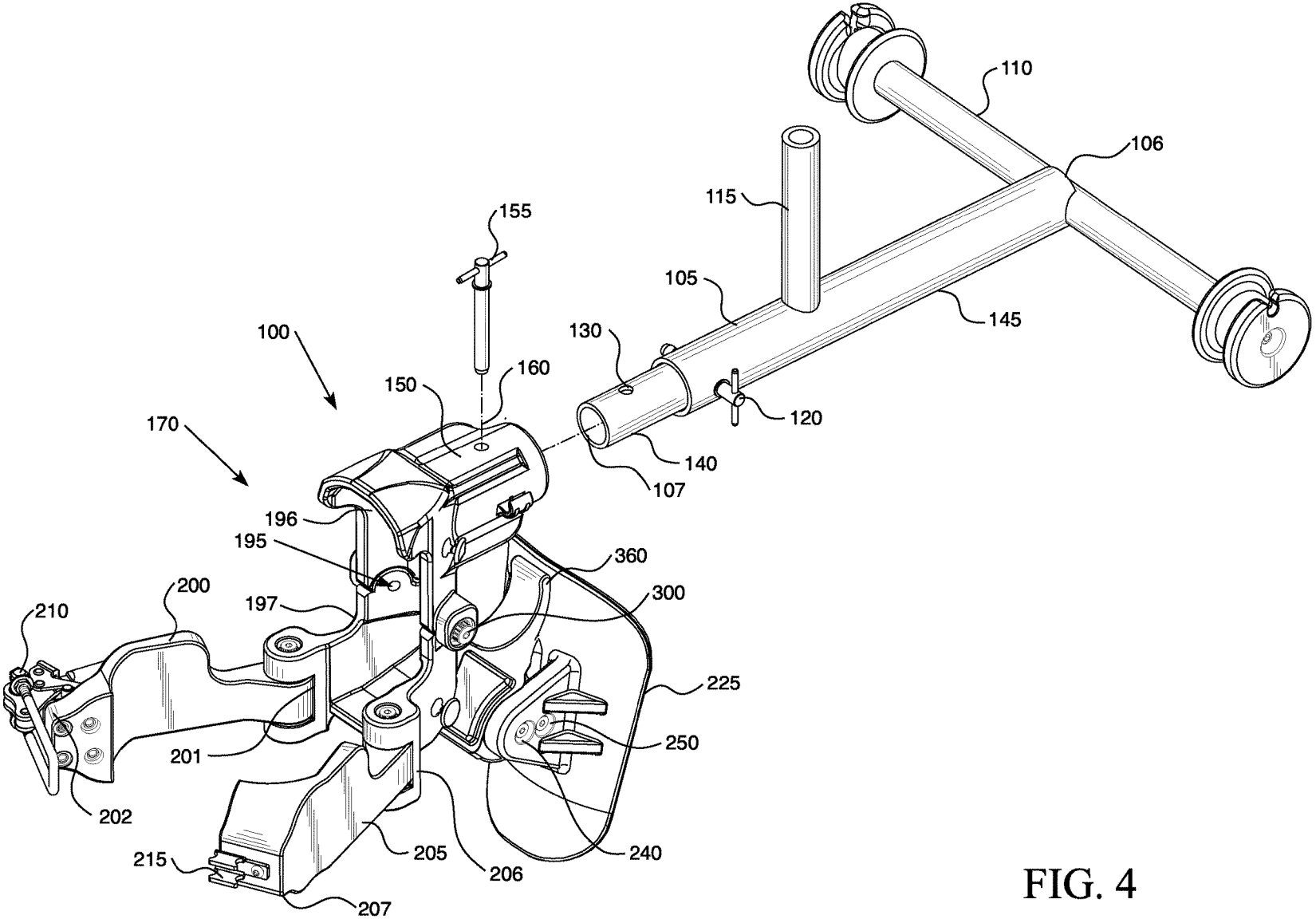
FIG. 4 depicts a partly exploded oblique view of an implementation of an adapter handle.
Figure 7:
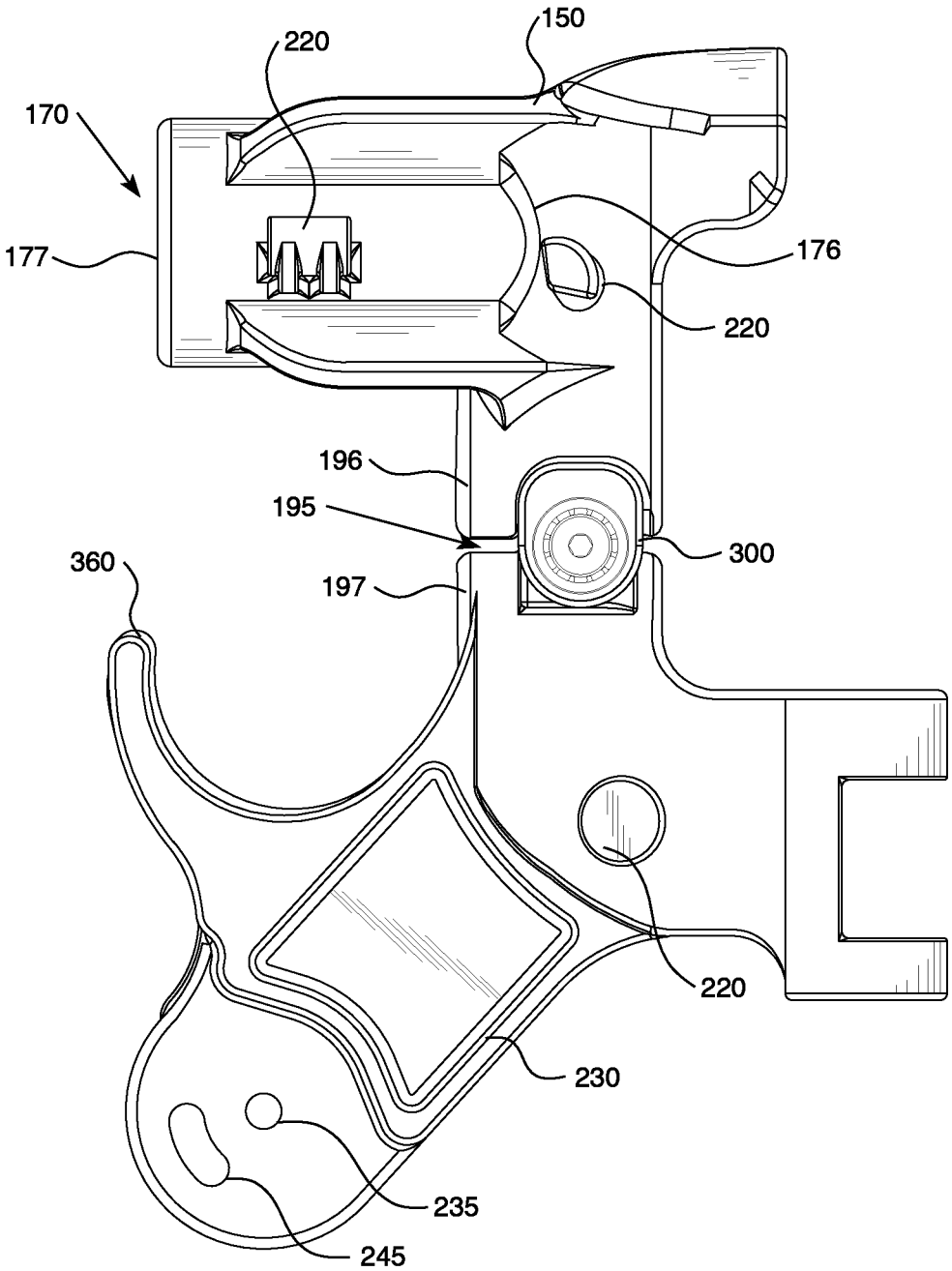
FIG. 7 depicts a side view of a hammer receiver.
Figure 8:
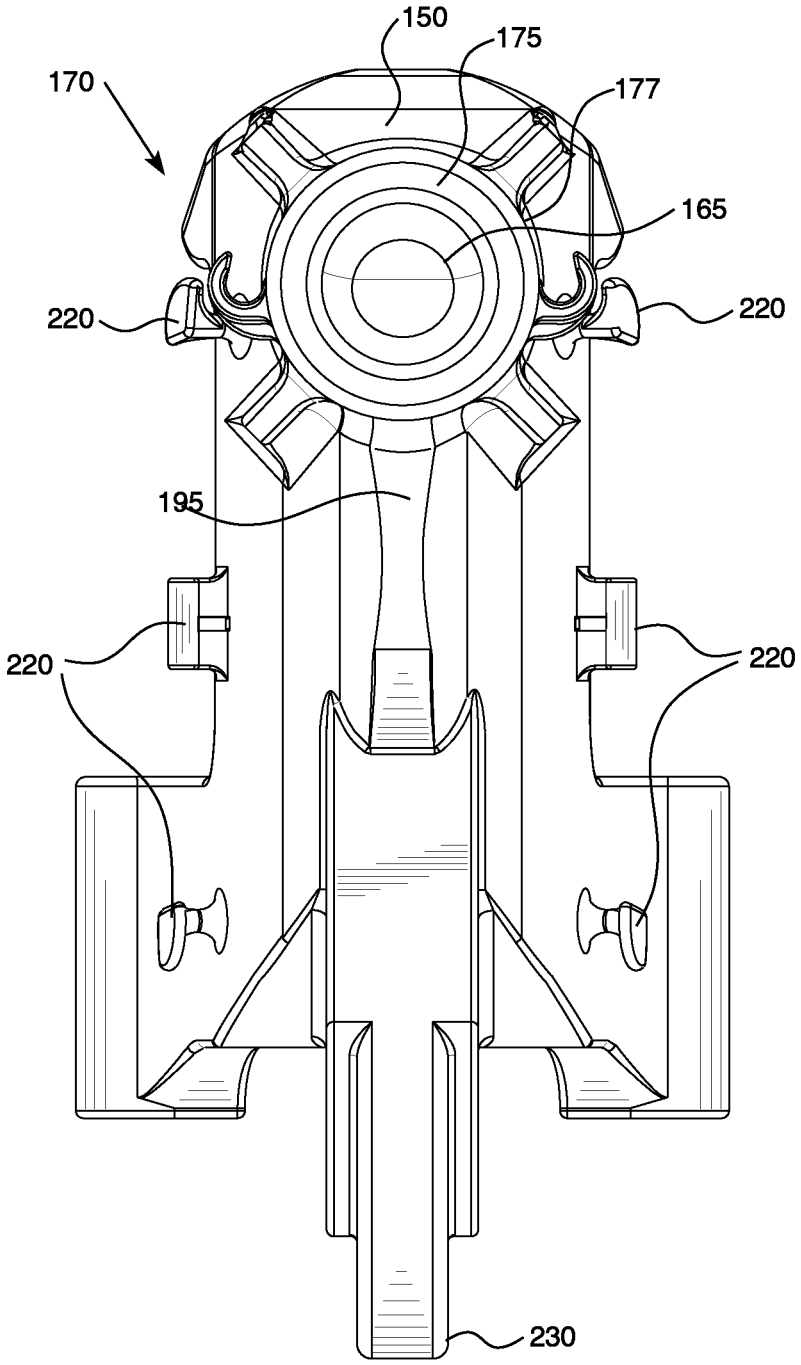
FIG. 8 depicts a rear view of a hammer receiver.
Figure 9:
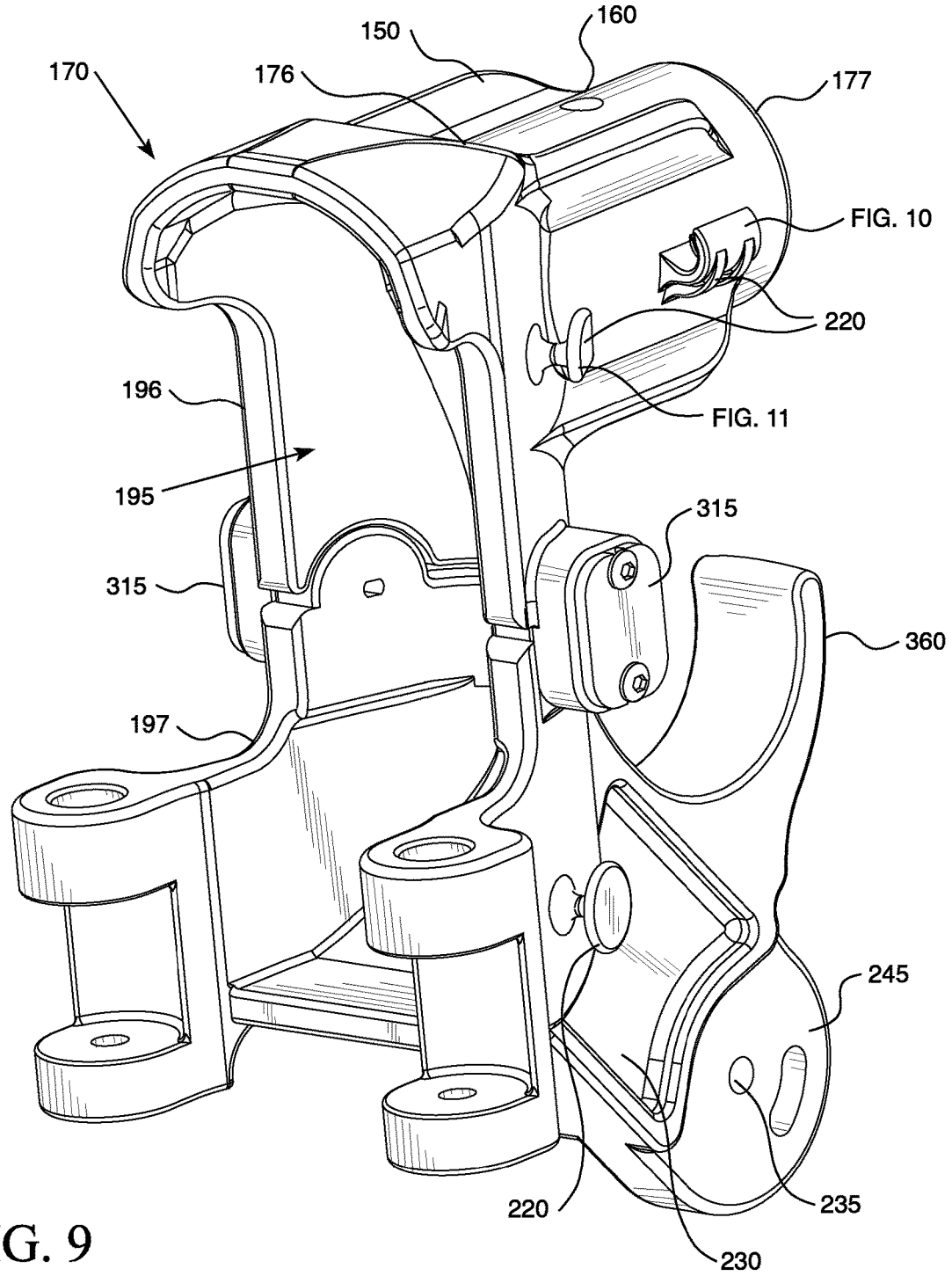
FIGS. 9 and 31 depict oblique frontal views of an implementation of a hammer receiver.
Figure 13:
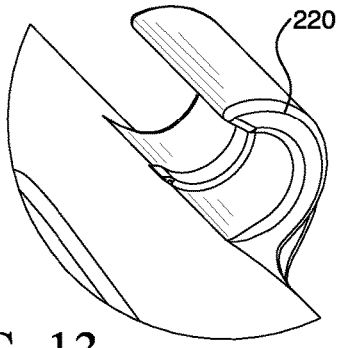
Figure 14:
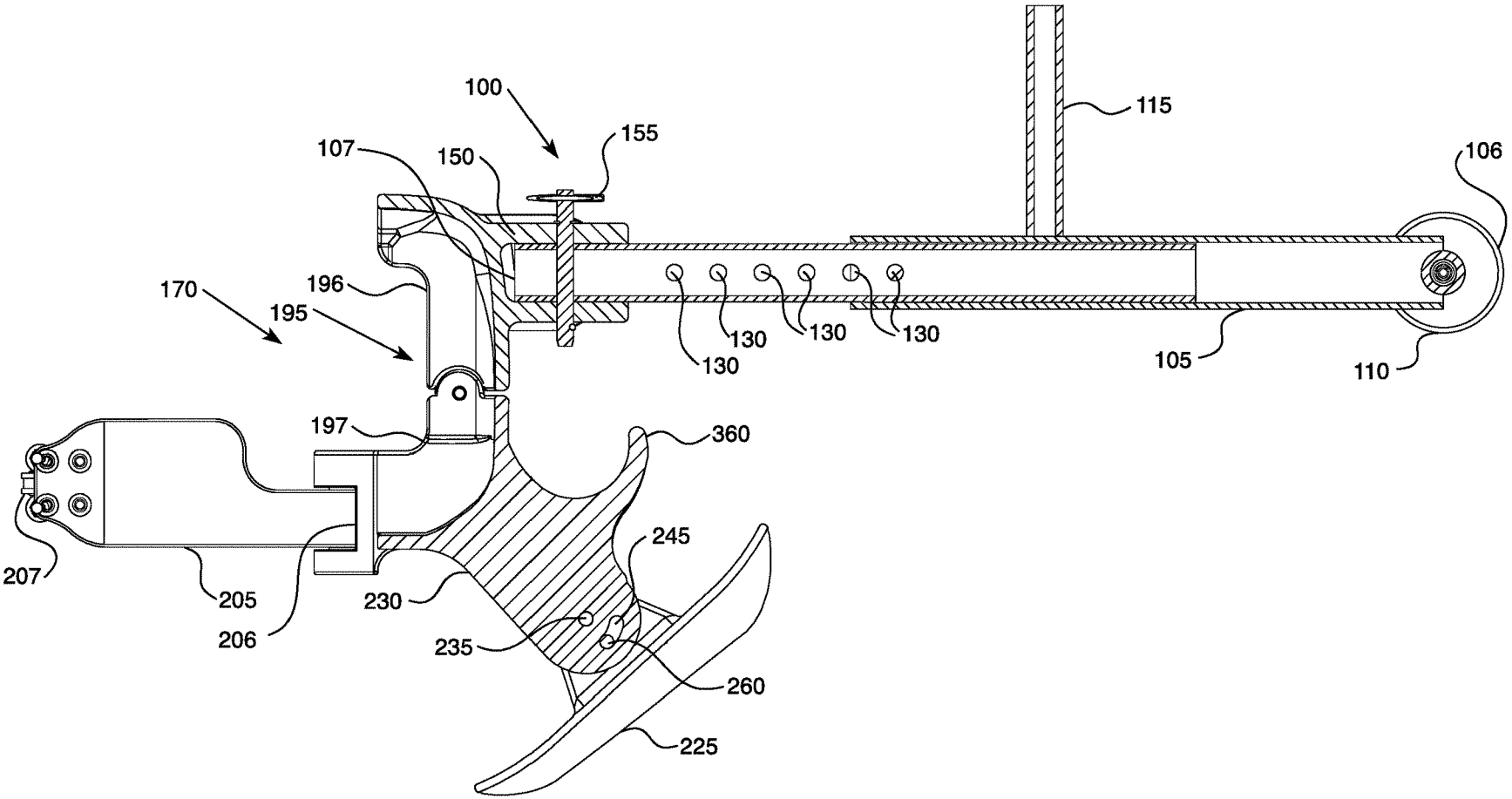
FIG. 14 depicts a side view of an implementation of an adapter handle.

FIG. 4 illustrates a partly exploded oblique view of an adapter handle 100. In particular, it illustrates an embodiment of an elongated shaft 105, having a first end 106 and a second end 107, detachably coupled from a hammer receiver 170. The hammer receiver 170 comprises a shaft receiver 150, the shaft receiver 150 further comprising a hollow substantially cylindrical channel 175 (FIG. 8), having a first end 176 (FIG. 7) and a second end 177 (FIGS. 7 and 8). To couple to the hammer receiver 170, the second end of the elongated shaft 107 may be inserted into the shaft receiver 150. A shaft pin 155 is configured to pass through a receiver shaft pin opening 160 and a shaft opening 130. FIGS. 9 and 20 further illustrate that the first end of the substantially cylindrical channel 176 may couple to the first housing segment 196 of a hammer handle housing 195. FIGS. 8 and 13 further illustrate that the second end of the substantially cylindrical channel 177 further comprises a receiver opening 165 configured to receive the second of the elongated shaft 107. FIG. 14 further illustrates a side view of the second end of the elongated shaft 107 being received by the shaft receiver 150.

In other embodiments, the elongated shaft 105 may be coupled to the hammer receiver 170 using one of many other types of securing mechanisms. Such secure mechanisms may include bolts, clasps, notches, mounts, latches, anchors, pins, hook and loop fasteners, magnets, threads and others.

Figure 5:
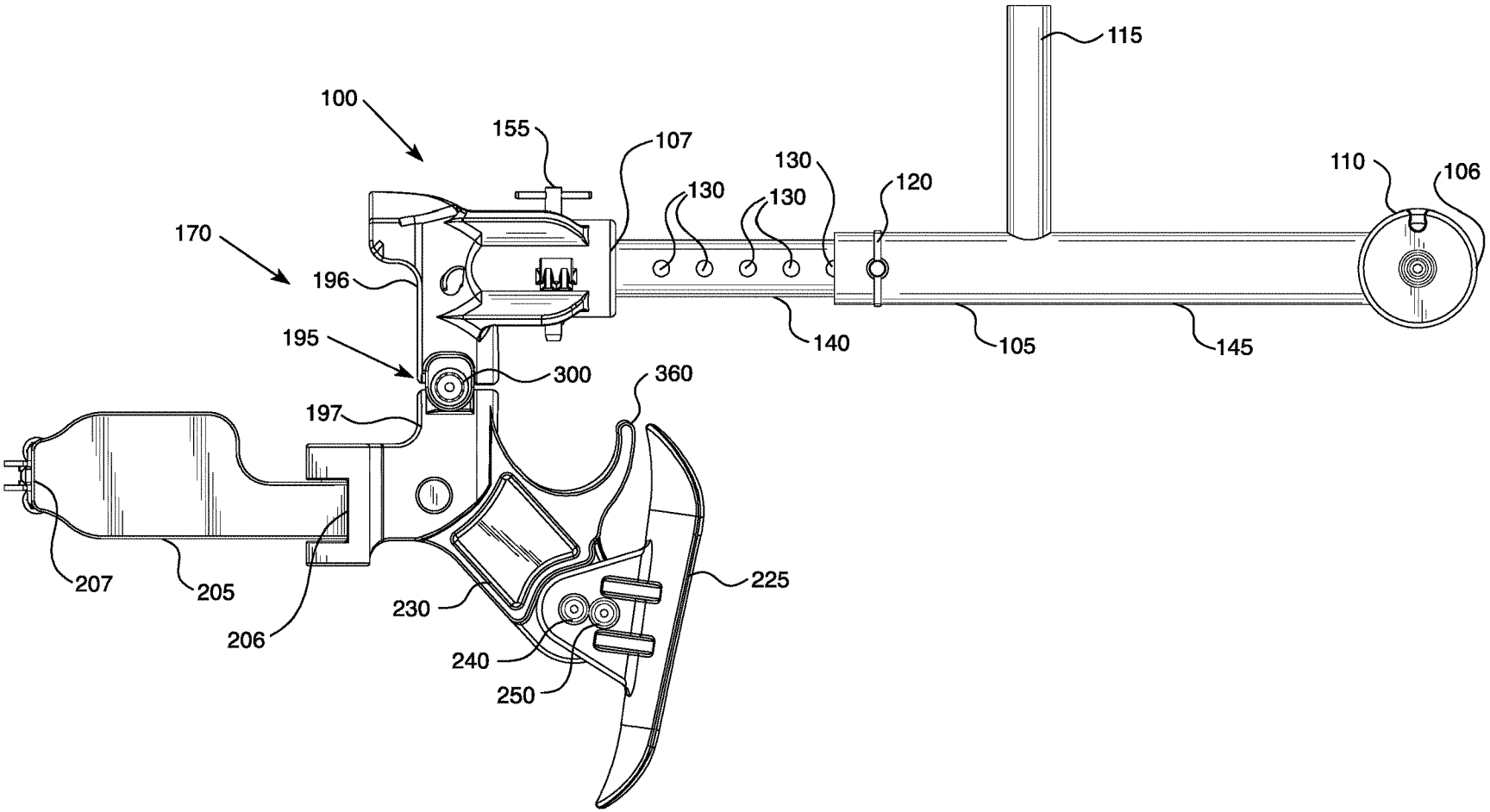
FIGS. 5 and 6 depict side views of an implementation of an adapter handle.
Figure 6:
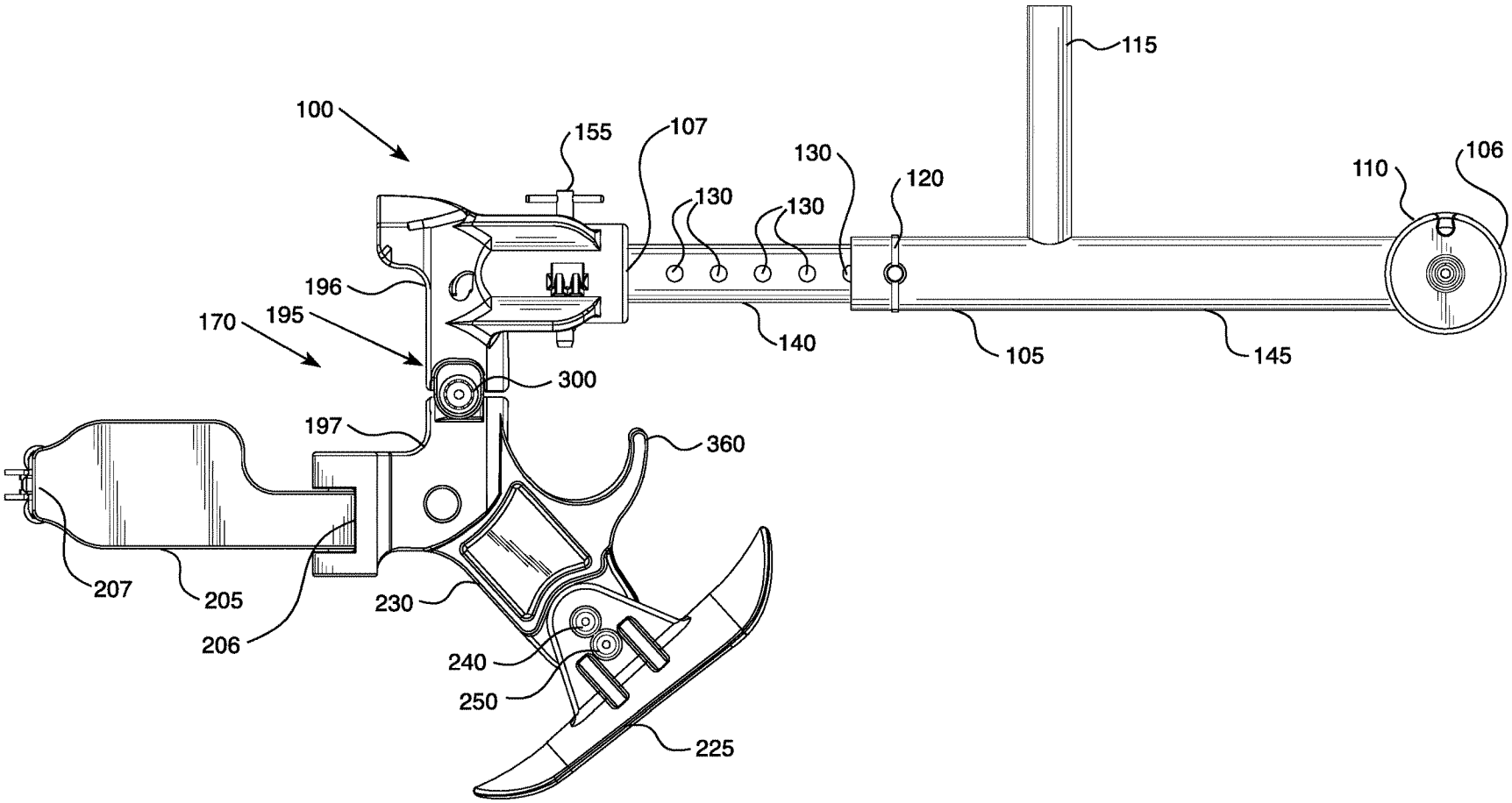

FIGS. 5 and 6 illustrate side views of an embodiment of an adapter handle 100. In particular, they illustrate the pivotal adjustability of the knee guard 225. A mount 230 may be coupled to the hammer receiver 170. The knee guard 225 may be coupled to the mount 230 using a securing pin 240 and a restriction pin 250 which can limit the pivotability of the knee guard 225.

Figure 15:
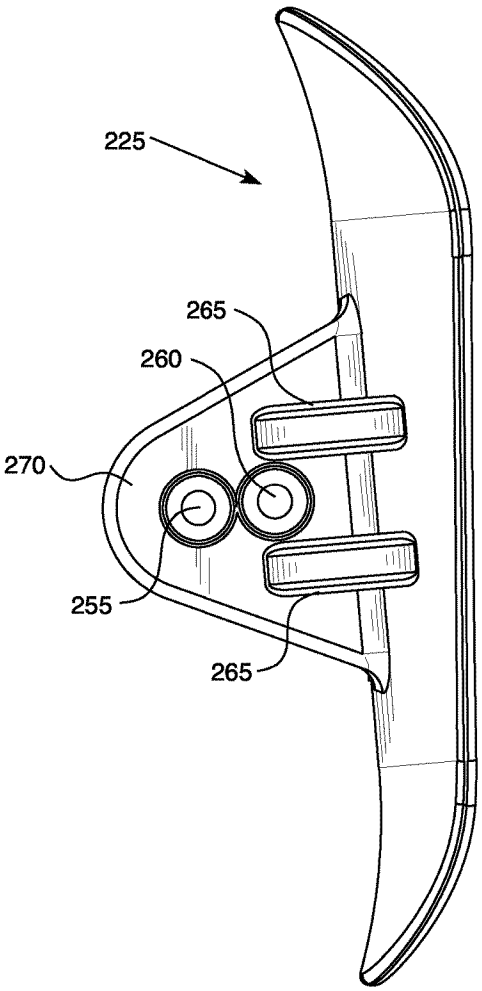
FIG. 15 depicts a rear view of a knee guard.

FIG. 7 illustrates a side view of a hammer receiver 170. This figure particularly demonstrates a mount opening 235 and a guide channel 245. A securing pin 240 (FIG. 6) may be configured to pass through the first knee opening 260 (FIG. 15) and the mount opening 235. This may allow the knee guard 225 (FIG. 15) to pivot about an axis of the securing pin 240 (FIG. 6). A restriction pin 250 (FIG. 6) may be configured to pass through the second knee guard opening 255 (FIG. 15) and the guide channel 245. The restriction pin 250 (FIG. 6) may then restrict the pivotal range of the knee guard 225 (FIG. 15).

FIG. 8 illustrates a rear view of a hammer receiver 170. This figure particularly illustrates a shaft receiver 150. The shaft receiver 150 comprises a hollow substantially cylindrical channel 175, having a first end 176 (FIG. 7) and a second end 177. The first end of the hollow substantially cylindrical channel 176 (FIG. 7) may couple to a first housing segment of a hammer handle housing 196 (FIGS. 1, 7, and 9). The second end of the substantially cylindrical channel 177 comprises a receiver opening 165 configured to receive the second of the elongated shaft 107 (FIGS. 1 and 14). This figure further illustrates a hammer handle housing 195. The hammer handle housing 195 is configured to receive a chipping hammer handle 395 (FIGS. 19 and 20). A chipping hammer 385 may fit snugly against the hammer handle housing 195 and be secured by a second secure arm 205 (FIGS. 19 and 20).

FIG. 9 illustrates an oblique frontal view of a hammer receiver 170. In the illustrated nonlimiting embodiment, the pivot point about which a first housing segment 196 and a second housing segment 197 of a hammer handle housing 195 pivot is effectuated by a rotary damper 315. The rotary damper 315 may also be understood to one having ordinary skill in the art as a particle break. The rotary damper 315 may allow a first housing segment 196 to pivot rotationally with respect to a second housing segment 197 about a pivot point, dampening vibrations. This allows the adapter handle 100 to be comprised of a variety of materials and facilitates use of a chipping hammer 385 (FIGS. 19 and 20) even without inherent vibration dampening features. If a chipping hammer 385 (FIGS. 19 and 20) with inherent vibration dampening capabilities is used or an adapter handle 100 is comprised primarily of at least one of a nylon, a plastic, a molded rubber, a machined rubber, or a urethane, then the rotary damper 315 may further reduce vibrations.

Figure 10:
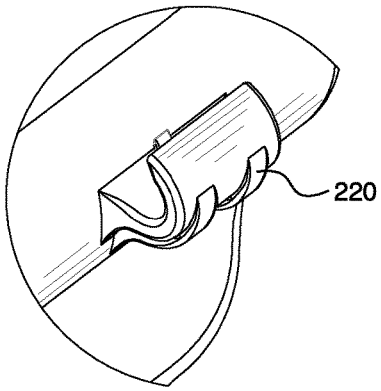
FIGS. 10, 11, and 13 depict oblique views of cable guides.
Figure 11:
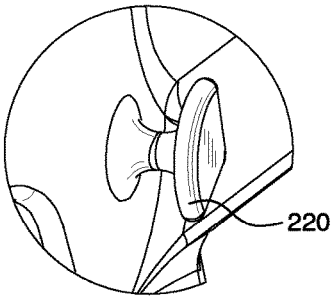

FIGS. 10, 11, and 13 illustrate oblique views of a cable guide 220.

Figure 12:
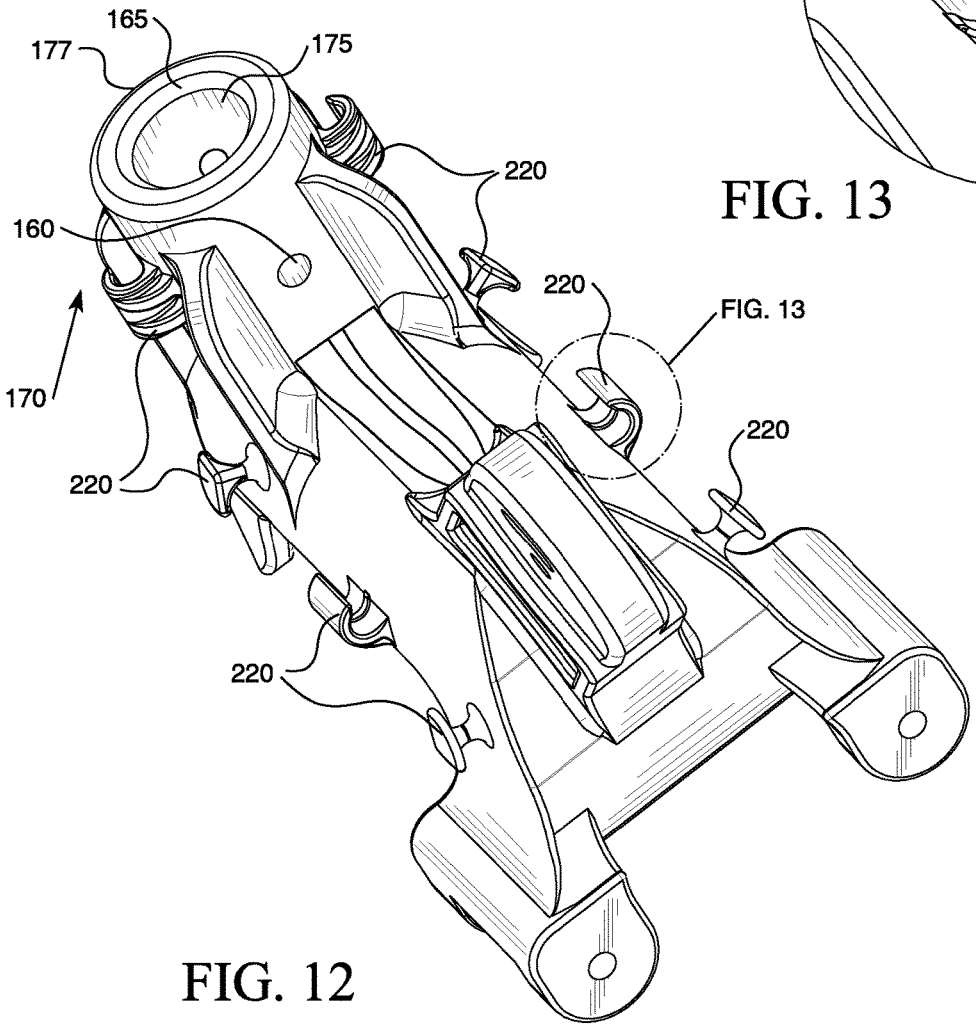
FIGS. 12 and 22 depict oblique rear views of an implementation of a hammer receiver.

FIG. 12 illustrates an oblique rear view of a hammer receiver 170. In particular, this figure illustrates a plurality of cable guides 220 coupled to the hammer receiver 170.

In other embodiments, the size and the structure of the cable guides 220 may vary. The cable guides 220 are used to direct a chipping hammer power cable away from a chipping hammer 385 (FIGS. 19 and 20) to an elongated shaft 105. Any number of cable guides 220 can be used to accomplish this task. Conversely, some embodiments may not be concerned with the location of the chipping hammer power cable. In these embodiments, cable guides 220 may be absent from the hammer adapter 100.

FIG. 14 illustrates a side view of an implementation of an adapter handle 100. This figure particularly illustrates a lock opening 125 in an outer portion 145 (FIG. 1) of an elongated shaft 105.

FIG. 15 illustrates a rear view of a knee guard 225. In particular, this figure illustrates a plurality of supports 265 coupled to a clevis 270. The plurality of supports 265 provide additional structure to the clevis 270 to prevent the clevis 270 from buckling when force is applied to the clevis 270 from a knee.

Figure 16:
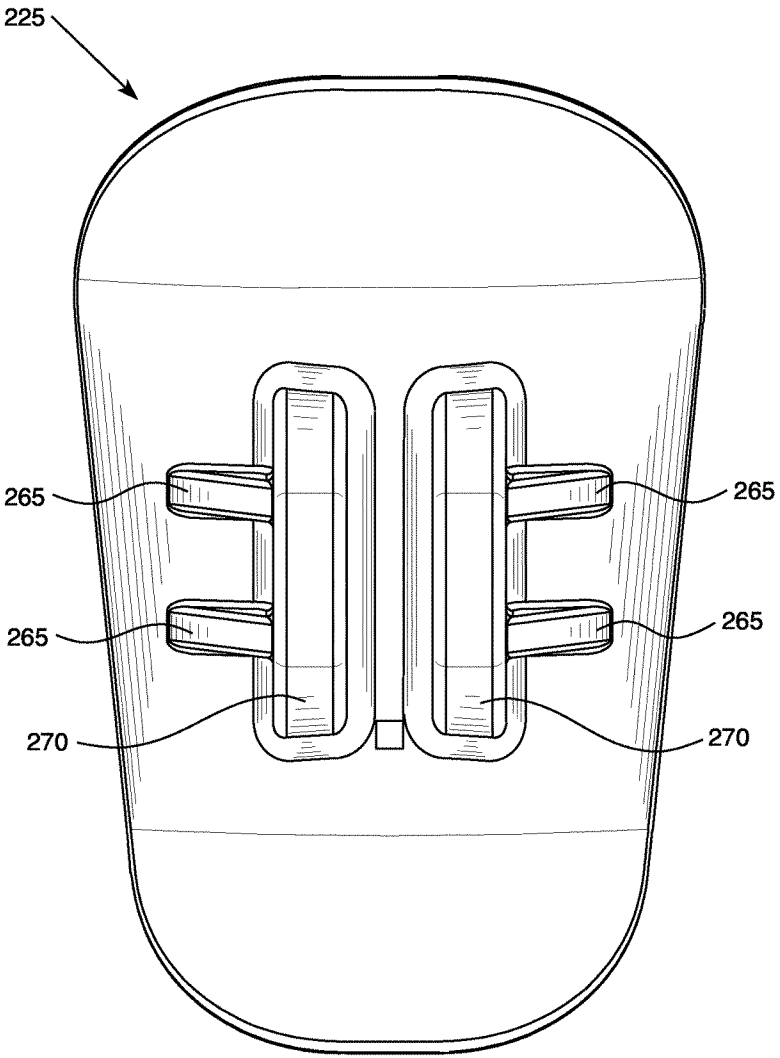
FIG. 16 depicts a side view of a knee guard.

FIG. 16 illustrates a side view of a knee guard 225. Particularly, this figure illustrates each wall of a clevis 270 having a first knee guard opening 260 and a second knee guard opening 255. The clevis 270 is configured to receive the mount 230 (FIG. 7). A securing pin 240 (FIG. 6) is configured to pass through the first knee opening 260 and the mount opening 235 (FIG. 7). This allows the knee guard 225 to pivot about an axis of the securing pin 240 (FIG. 6). A restriction pin 250 (FIG. 6) is configured to pass through the second knee guard opening 255 and the guide channel 245 (FIG. 7). The restriction pin 250 (FIG. 6) can then restrict the pivotal range of the knee guard 225.

In some embodiments, an additional support 265 for a clevis 270 may be unnecessary. In these embodiments, the plurality of supports 265 may be absent from the knee guard 225.

In other alternative embodiments, a knee guard 225 may not comprise a clevis 270. For example, these alternative embodiments may replace a clevis 270 with a single wall coupled to the knee guard 225 having a first knee guard opening 260 and a second knee guard opening 255.

Additional alternative embodiments may not restrict the pivotal range of the knee guard 225. In these embodiments, a restriction pin 250, a second knee guard opening 255, and a guide channel 245 may be absent from an adapter handle 100.

Figure 18:
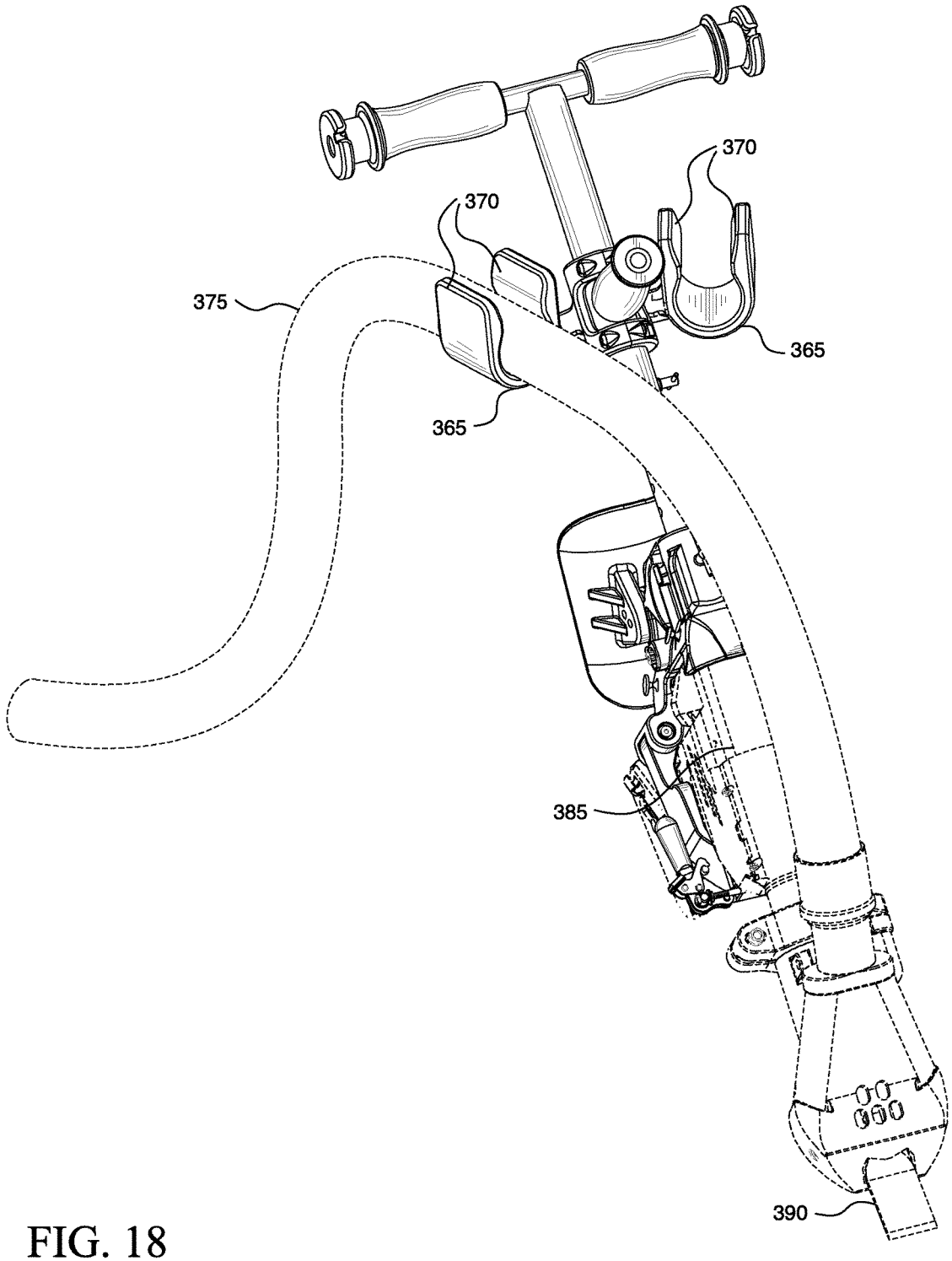

FIGS. 17 and 18 illustrate oblique views of an implementation of an adapter handle 100. These figures particularly illustrate how a vacuum hose 375 may be secured by a vacuum hose guide 360. The vacuum hose 375 is snug against the substantially concave cradle 365 and secured by the raised walls 370. In other embodiments, the location and number of hose guides 360 may vary.

FIG. 19 illustrates an oblique side view of an implementation of an adapter handle 100. This figure particularly illustrates how a chipping hammer 385 may fit snugly against the hammer handle housing 195 and be secured by a second secure arm 205. In this figure, it is clear that the adapter handle 100 may be moved by gripping an end grip 110 and moving the end grip 110. The blade of a chipping hammer 390 would consequently be moved. Tile is removed from a tiled surface when the blade of the chipping hammer 390 contacts the tiled surface.

FIG. 20 illustrates a side view of an implementation of an adapter handle 100. This figure illustrates a portion of the embodiment of the adapter handle 100 illustrated in FIG. 19 from a different view. This figure also particularly illustrates how a chipping hammer 385 may fit snugly against the hammer handle housing 195 and be secured by a second secure arm 205. This figure further illustrates a side view of a hollow substantially cylindrical channel 175 (FIG. 8) having a first end 176 and a second end 177.

Figure 21:
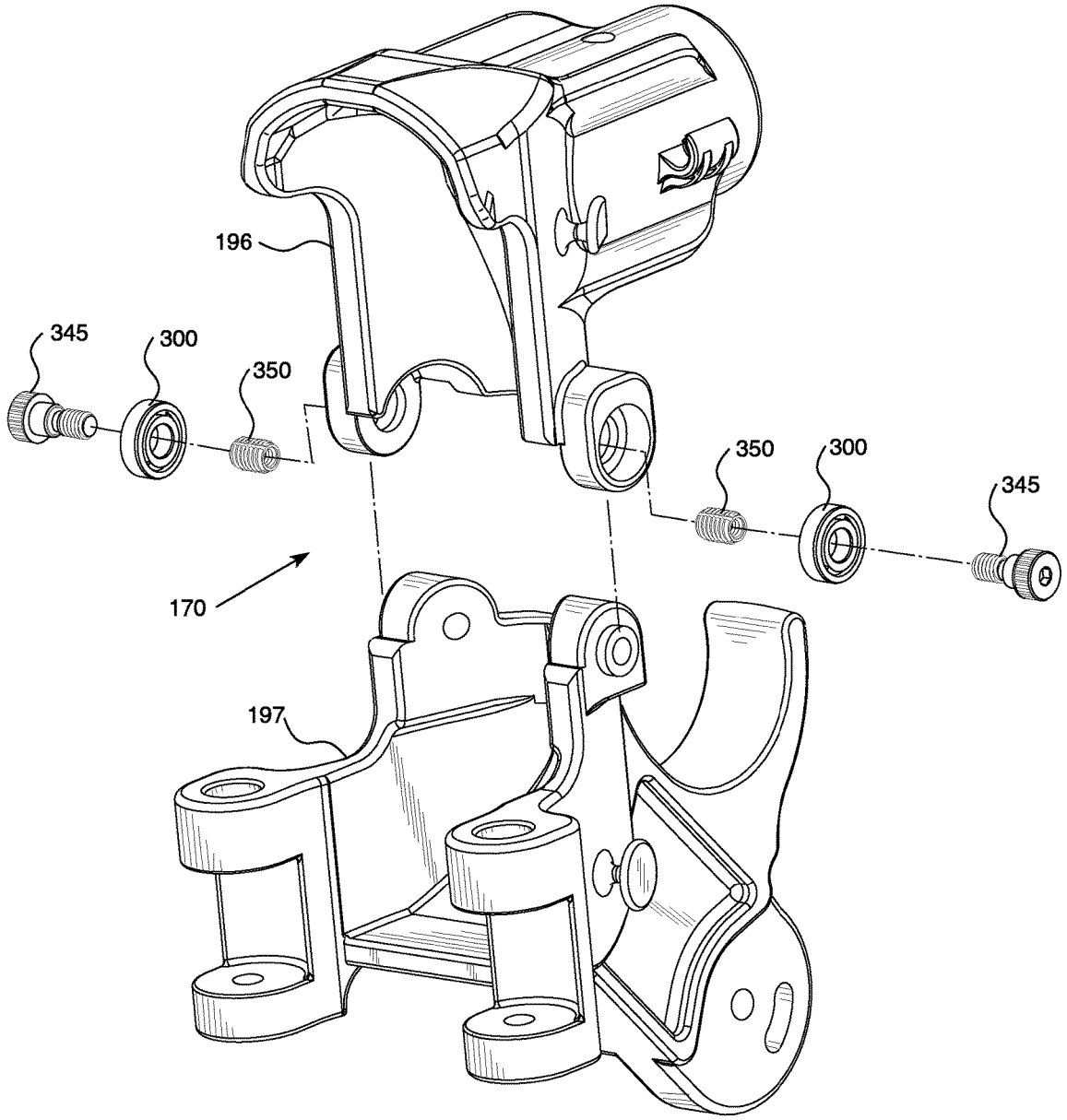
FIGS. 21 and 26, 27, 30, 33, 37, and 41 depict exploded oblique frontal views of implementations of hammer receivers.

FIG. 21 illustrates an exploded oblique frontal view of a nonlimiting embodiment of a hammer receiver 170 wherein a pivot point between a first housing segment 196 and a second housing segment 197 may be effectuated by a ball bearing 300. A shoulder bolt 345 may pass through the inner ring of a ball bearing 300 and be screwed into a threaded insert 350. The threaded insert 350 may be made of brass. The threaded insert 350 is a fastener that has external and internal threads. A threaded insert 350 may be screwed into a pilot hole in the hammer receiver 170 tightly against the external threads, thereby becoming affixed to the hammer receiver 170. The threaded portion of the shoulder bolt 345 may be screwed and unscrewed hundreds of times without damaging the hammer receiver 170. This nonlimiting embodiment allows the first housing segment 196 to rotationally pivot with respect to the second housing segment 197 about a pivot point, dampening vibrations in the adapter handle 100. A pivot point effectuated by a ball bearing 300 is also well-illustrated in FIGS. 1, 4, 5, 6, 7, 19, 20, 22, and 23. FIGS. 22 and 23 further illustrate a hammer receiver 170 comprising a ball bearing 300 which further comprises a spring retainer 305 which may further dampen vibrations.

Figure 24:
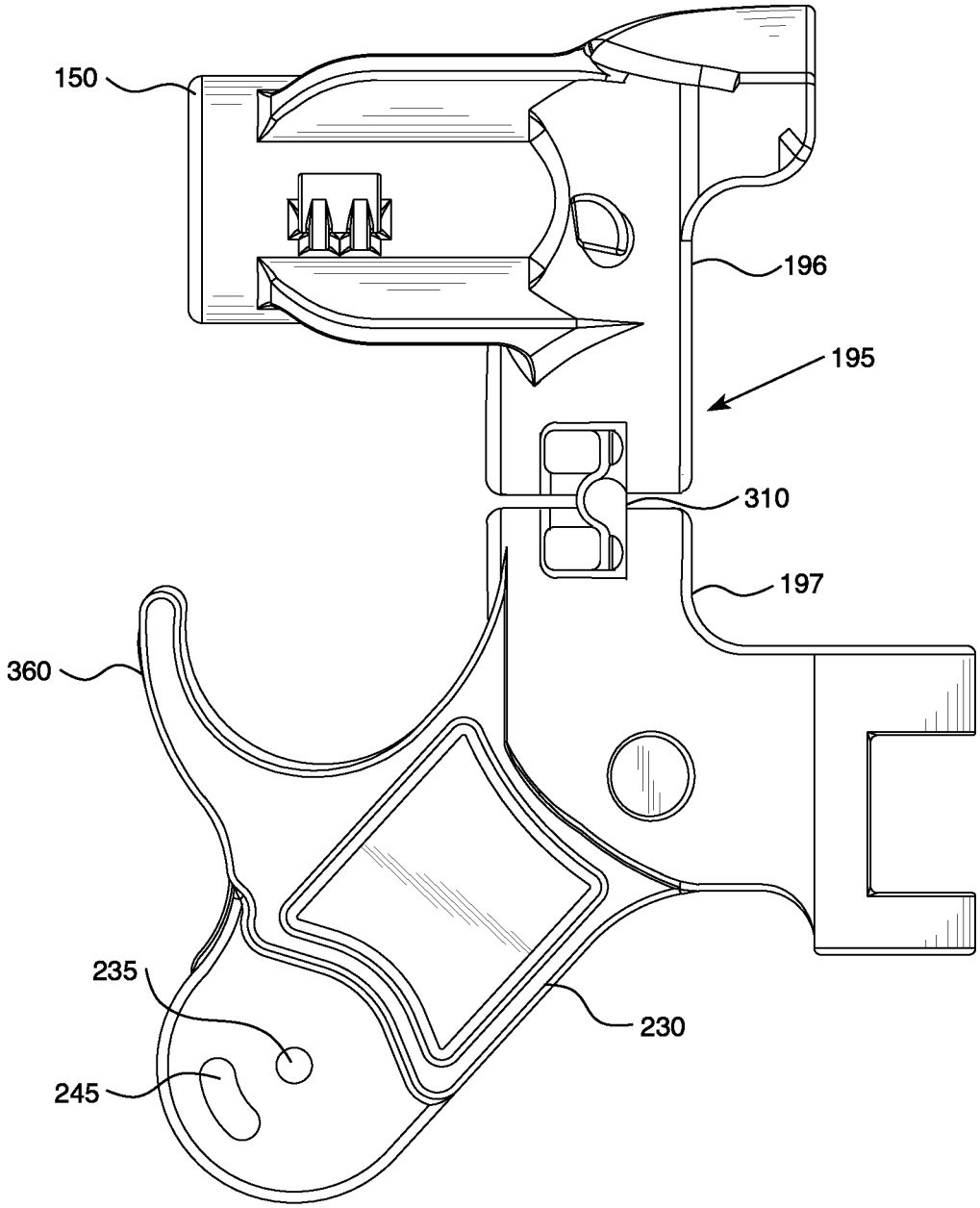
FIGS. 24, 28, 34, and 40 depict side views of hammer receivers.
Figure 25:
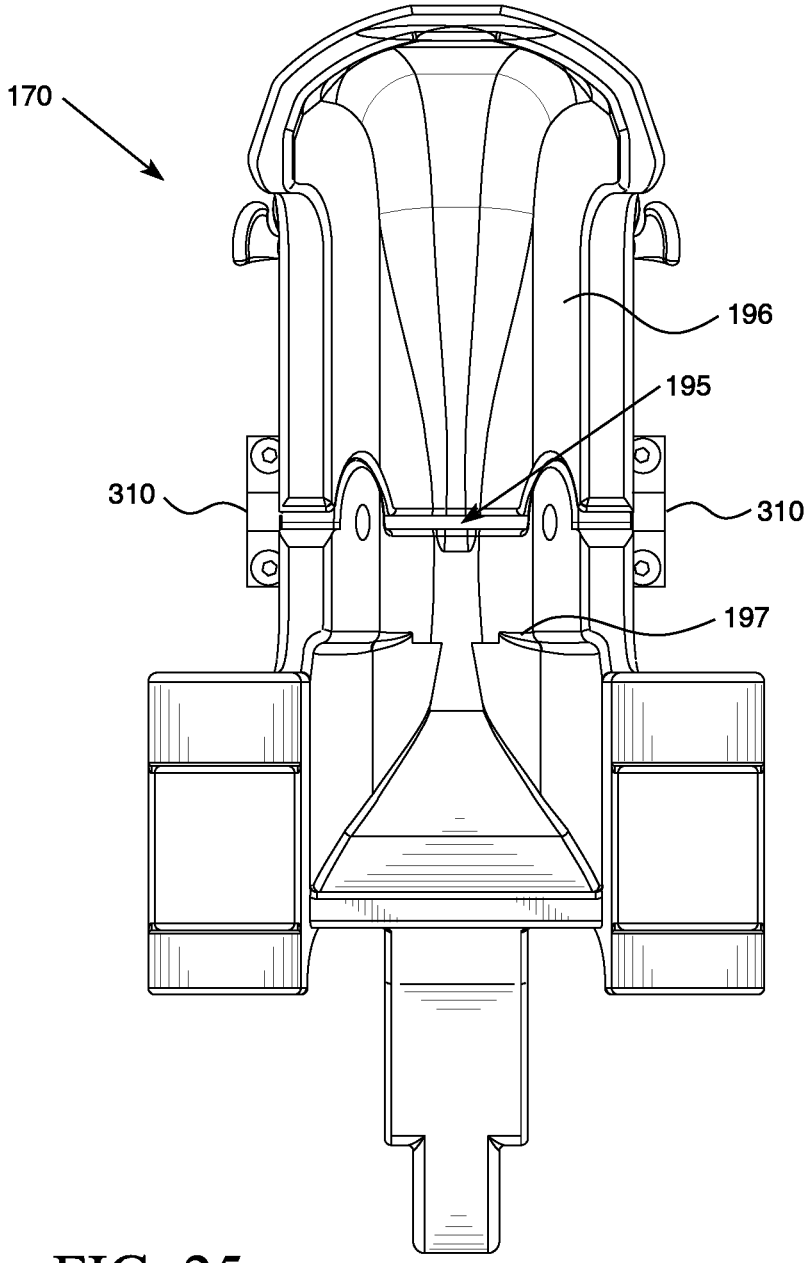
FIG. 25 depicts a top view of a hammer receiver.
Figure 26:
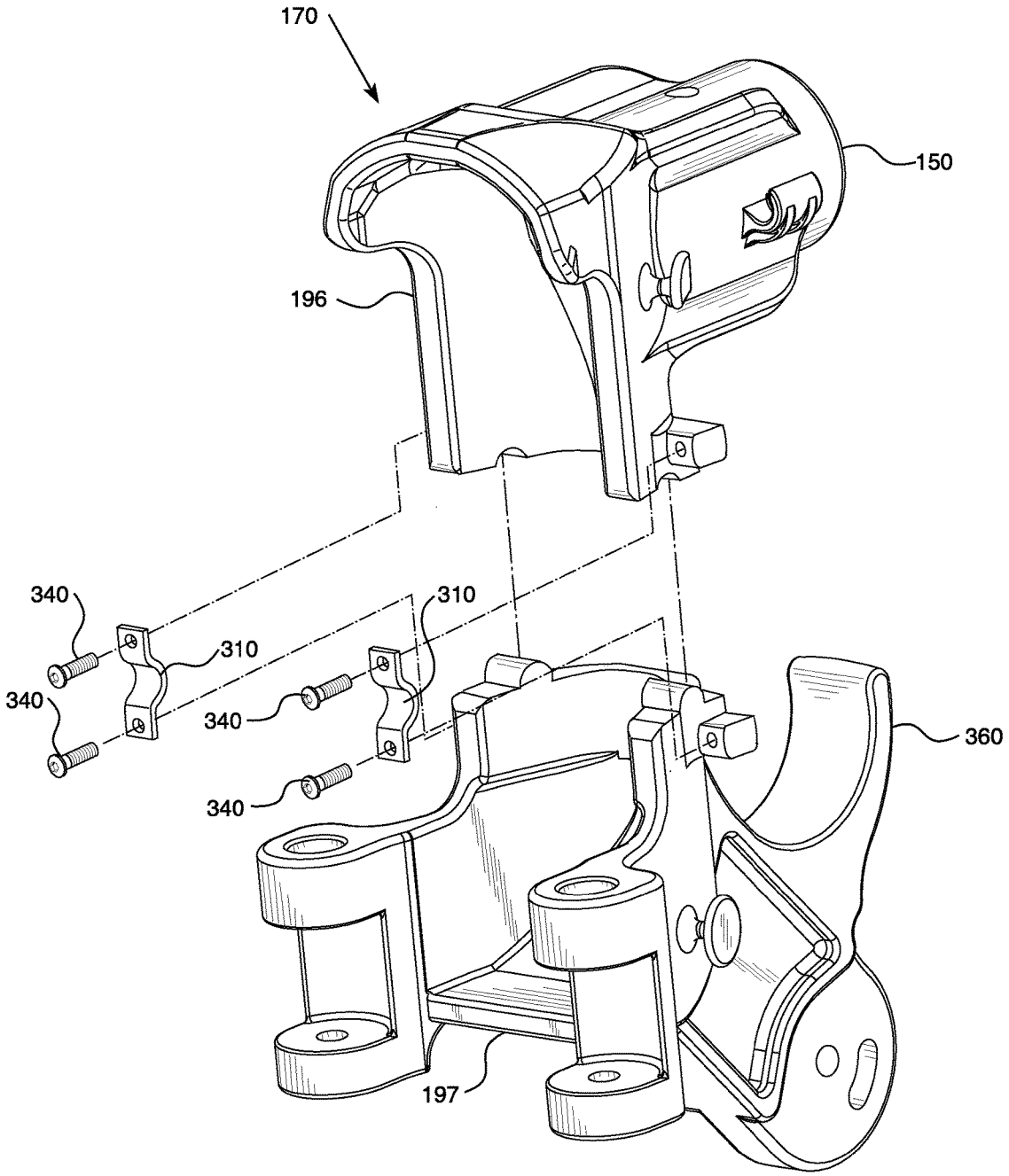

FIG. 26 illustrates an exploded oblique frontal view of another nonlimiting embodiment of a hammer receiver wherein a pivot point between a first housing segment 196 and a second housing segment 197 may instead be effectuated by a leaf spring 310. The leaf spring 310 may be screwed into a hammer receiver 170 with a plurality of screws 340. The first housing segment 196 may rotationally pivot with respect to the second housing segment 197 about a pivot point. The leaf spring 310 may compress and absorb energy, dampening vibrations in the adapter handle 100. The leaf spring 310 in this embodiment may be further viewed from a side view in FIG. 24 and from a top view in FIG. 25. Moreover, FIG. 24 illustrates how the elements of this exploded view may appear upon assembly.

FIG. 27 illustrates an exploded oblique frontal view of another nonlimiting embodiment of a hammer receiver wherein a pivot point between a first housing segment 196 and a second housing segment 197 may instead be effectuated by torsion spring 335. The torsion spring 335 stores mechanical energy. When energy is put into the torsion spring 335, it tightens. The torsion spring 335 has a tendency to return to its initial shape. When energy is released, the torsion spring 335 undergoes elastic rebound as it untwists. The first housing segment 196 may rotationally pivot with respect to the second housing segment 197 about a pivot point, dampening vibrations in the adapter handle 100. The torsion spring 335 in this embodiment may be further viewed from a side view in FIG. 28 and a cross-sectional top view in FIG. 29. Moreover, FIG. 28 illustrates how the elements of this exploded view may appear upon assembly.

Figure 30:
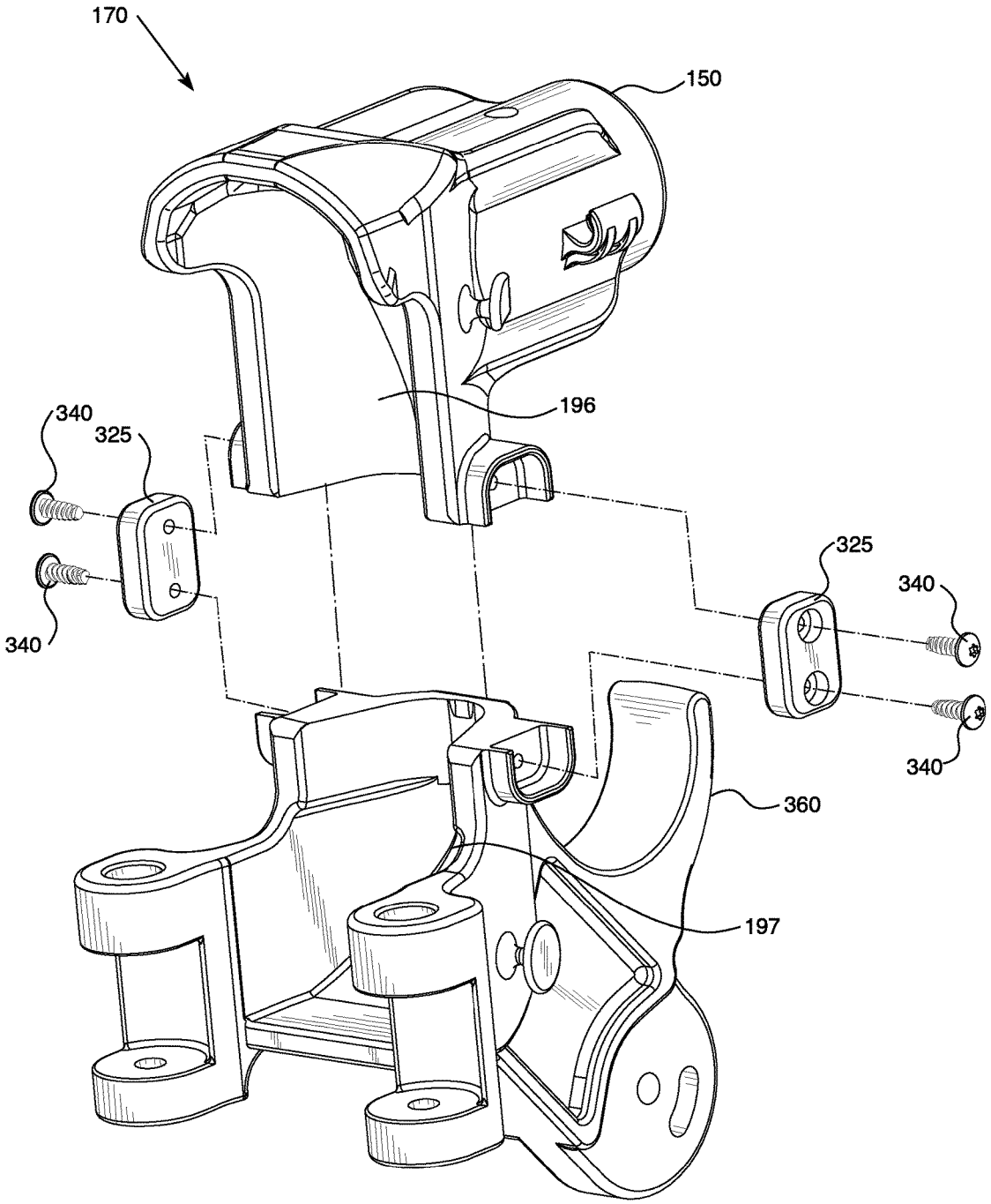

FIG. 30 illustrates an exploded oblique frontal view of another nonlimiting embodiment of a hammer receiver 170 wherein a pivot point between a first housing segment 196 and a second housing segment 197 may instead be effectuated by rubber plate 325. The rubber plate 325 may be screwed into a hammer receiver 170 with a plurality of screws 340. The first housing segment 196 may rotationally pivot with respect to the second housing segment 197 about a pivot point, dampening vibrations in the adapter handle 100. The rubber plate 325 in this embodiment may be further viewed from an oblique frontal view in FIG. 31 and a cross-sectional top view in FIG. 32.

Figure 33:
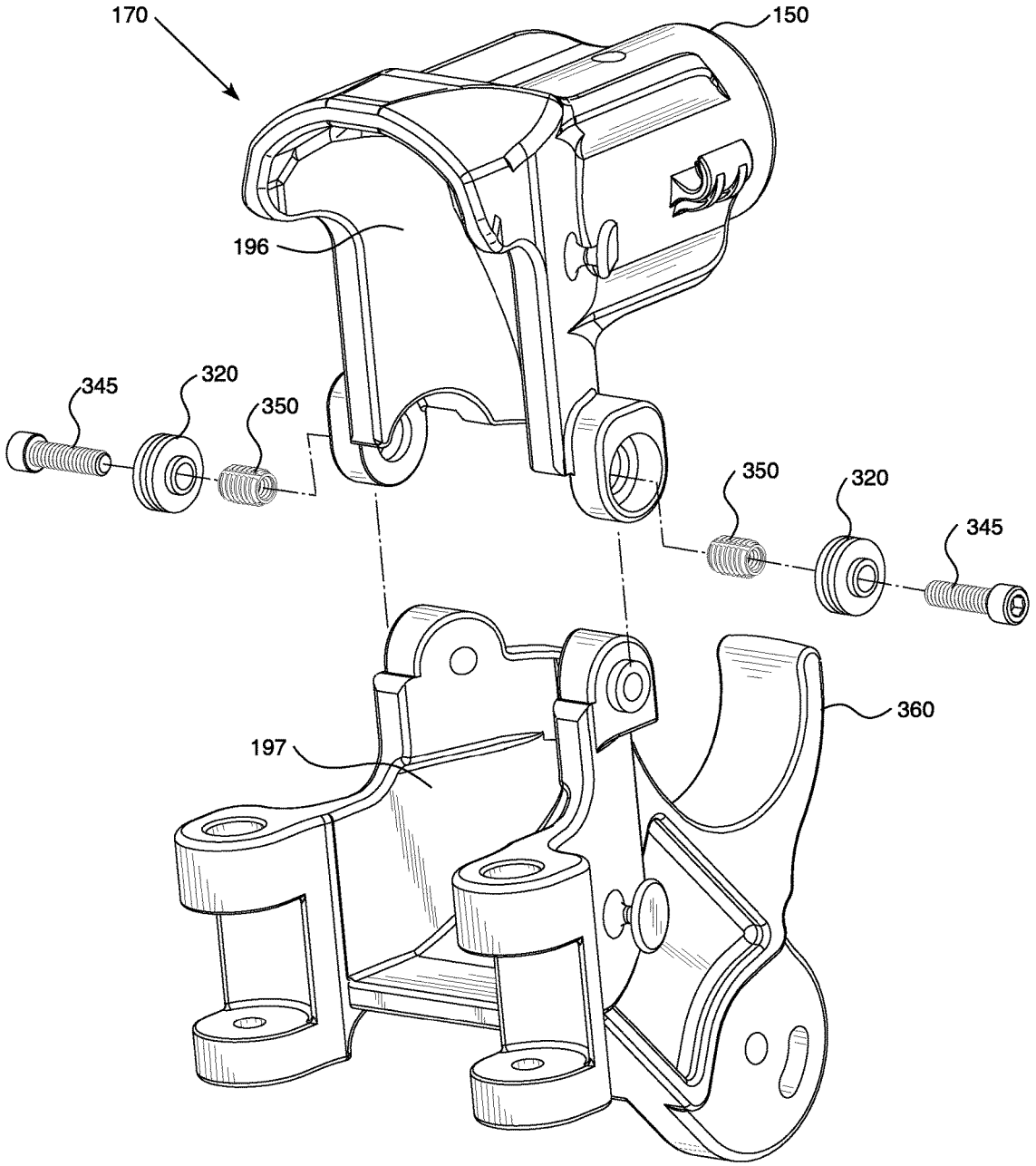
Figure 34:
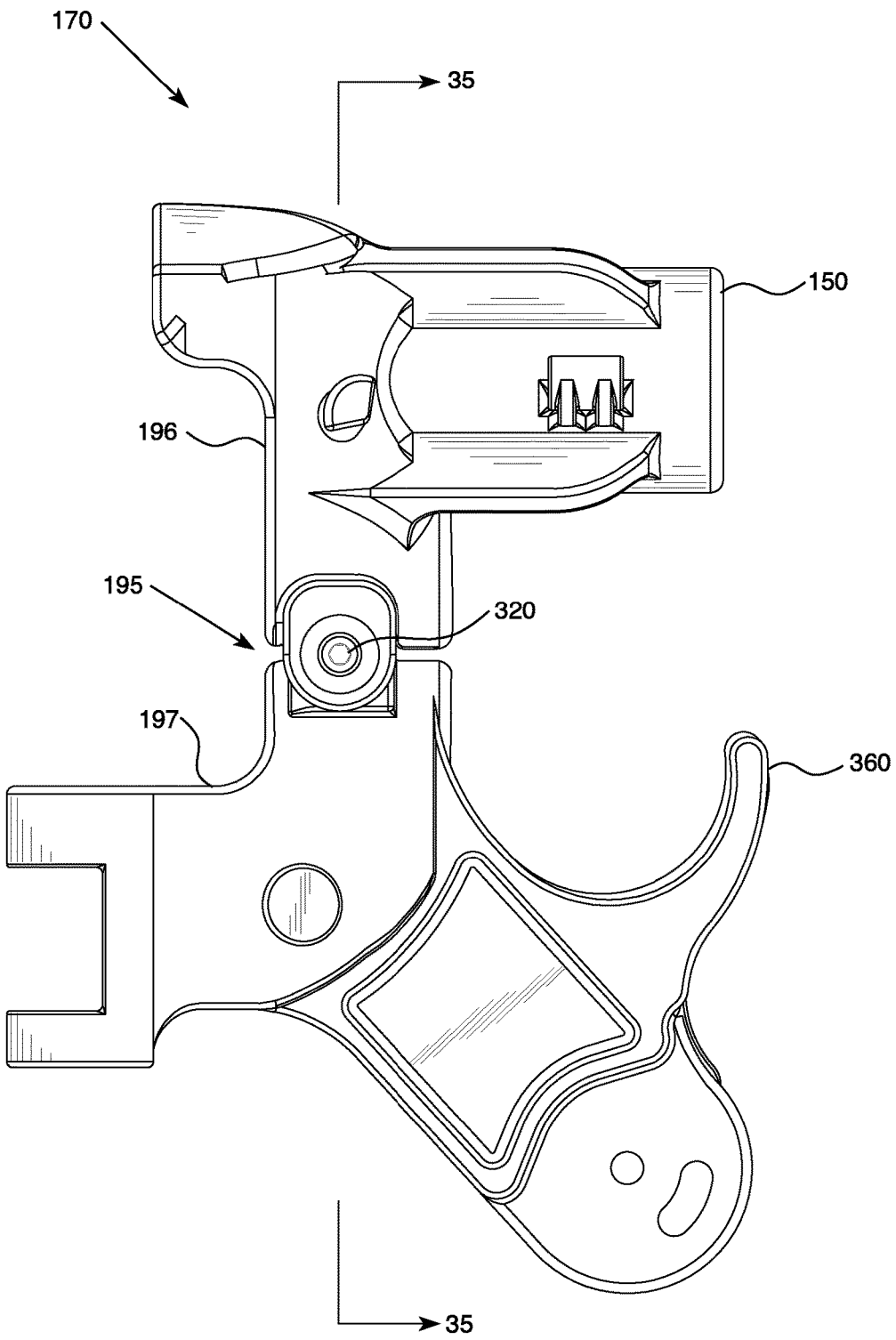
Figure 35:
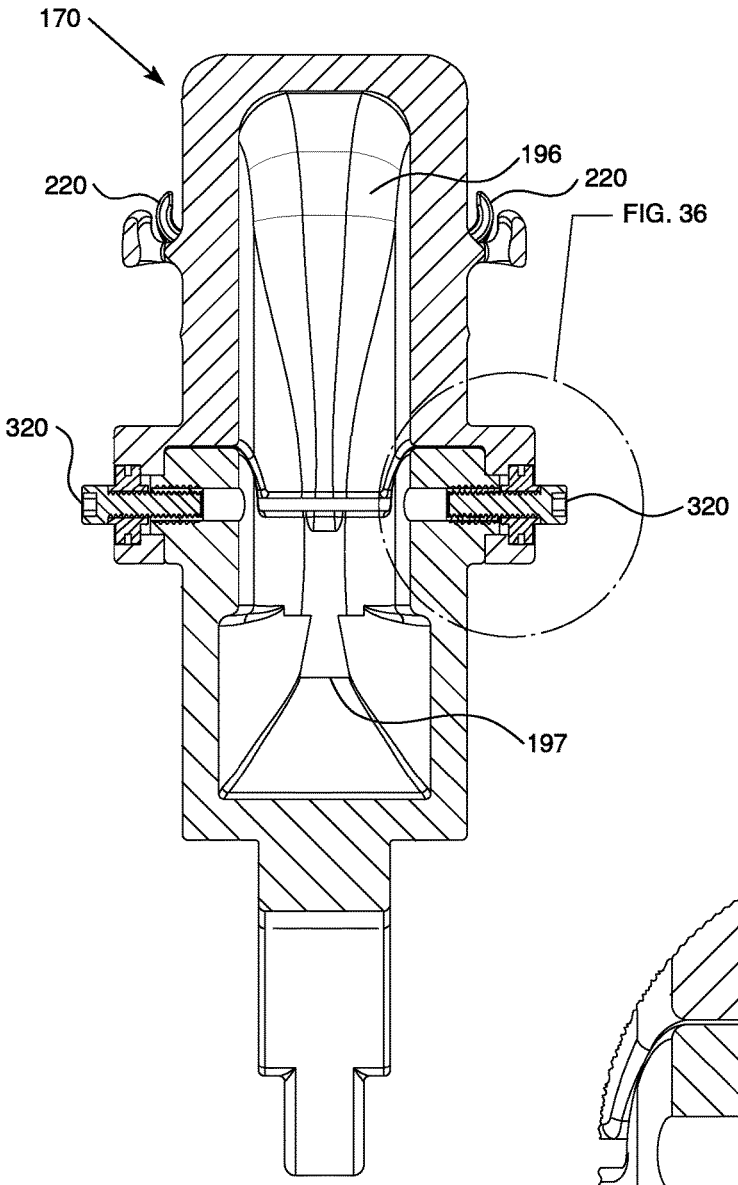
Figure 36:
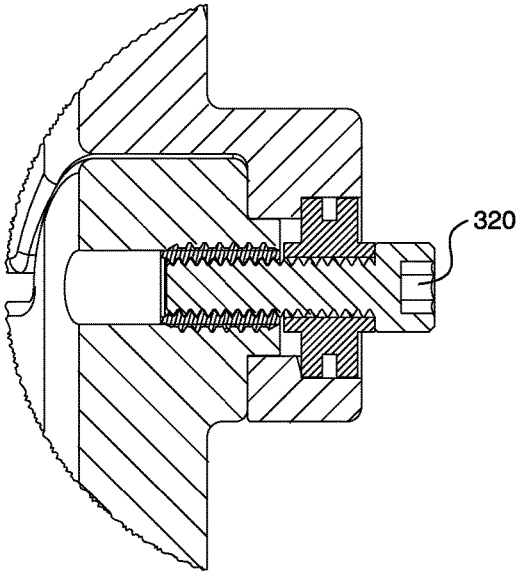
FIG. 36 depicts a cross-sectional top view of a rubber grommet of a hammer receiver.

FIG. 33 illustrates an exploded oblique frontal view of another nonlimiting embodiment of a hammer receiver 170 wherein a pivot point between a first housing segment 196 and a second housing segment 197 may instead be effectuated by rubber grommet 320. A shoulder bolt 345 may pass through the rubber grommet 320 and be screwed into a threaded insert 350. The first housing segment 196 may rotationally pivot with respect to the second housing segment 197, dampening vibrations in the adapter handle 100. The rubber grommet 320 in this embodiment may be further viewed from a side view in FIG. 34 and cross-sectional top views in FIGS. 35 and 36. Particularly, FIG. 36 provides a closer view of how the rubber grommet 320 effectuates a pivot point between the first housing segment 196 and the second housing segment 197. Moreover, FIG. 34 illustrates how the elements of this exploded view (FIG. 33) may appear upon assembly.

Figure 37:
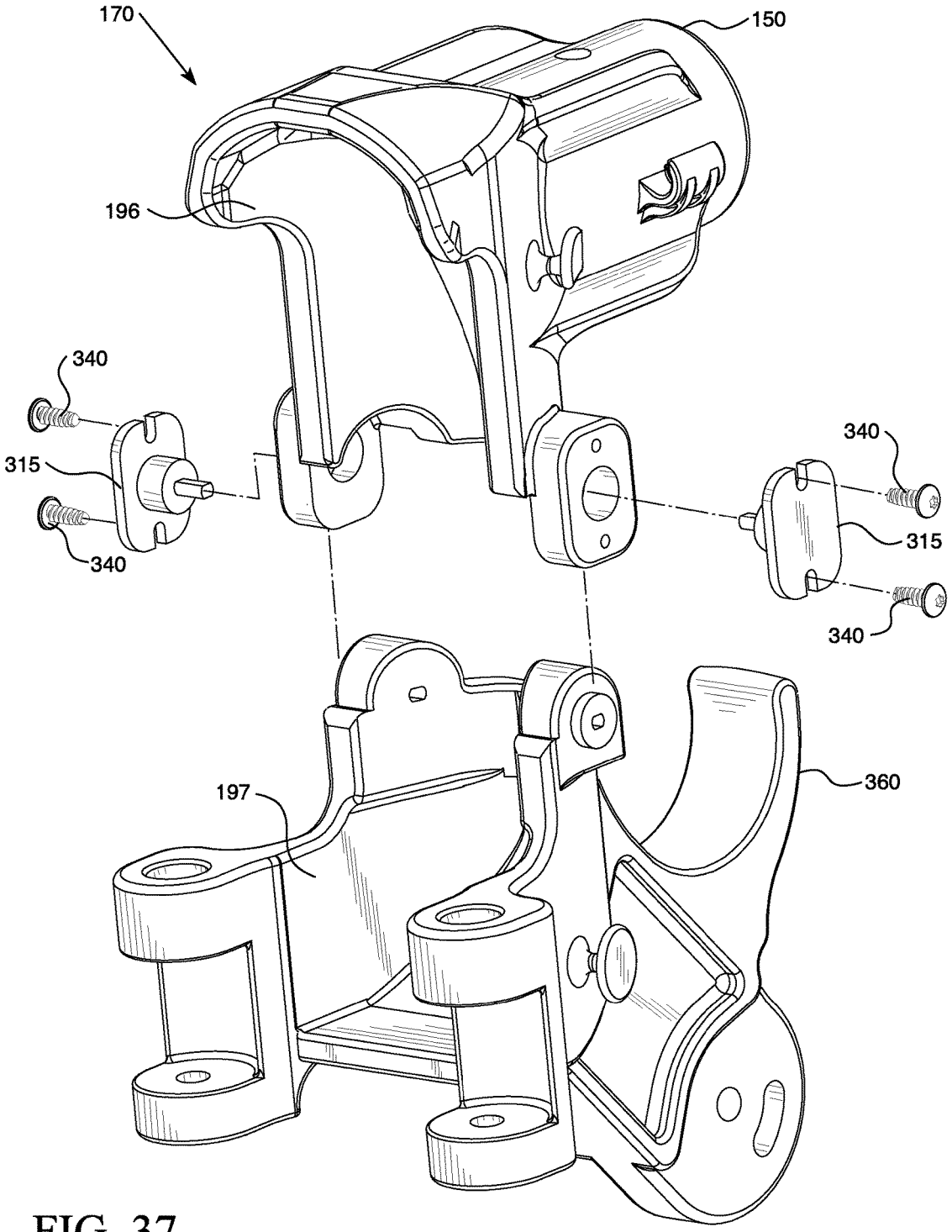
Figure 38:
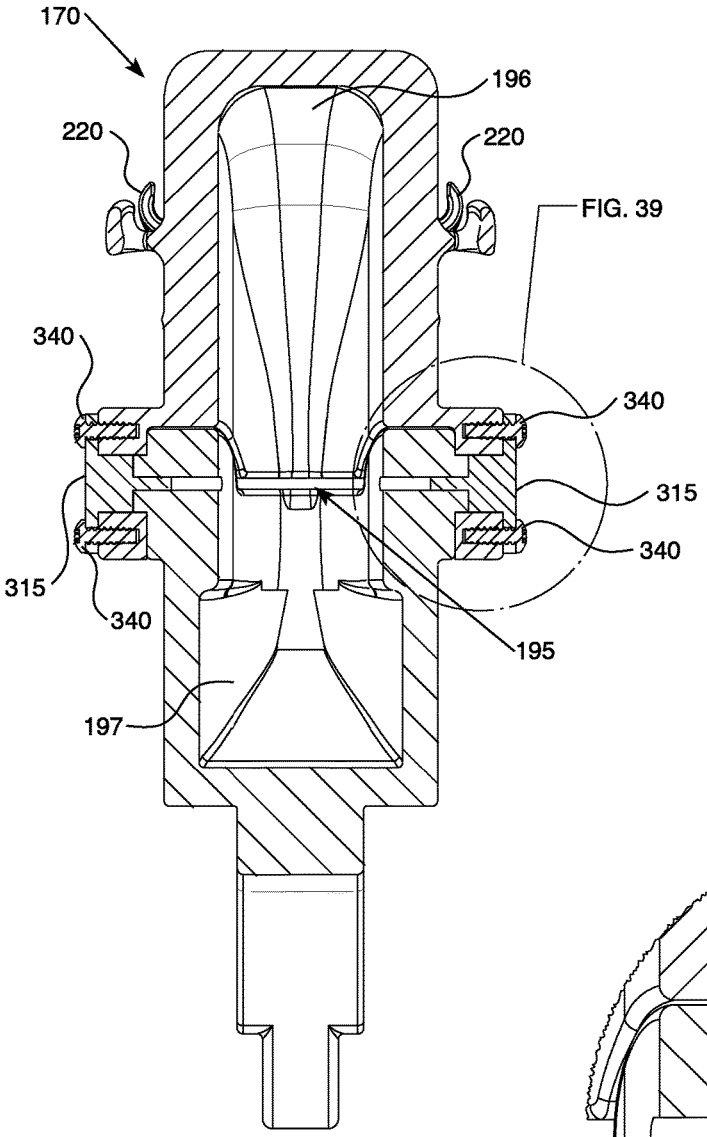
Figure 39:
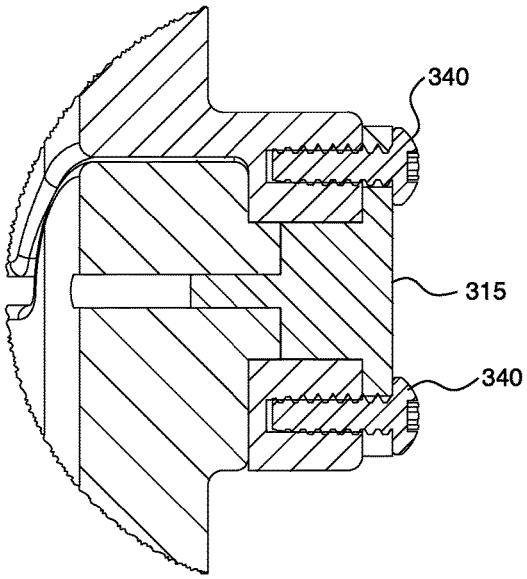
FIG. 39 depicts a cross-sectional top view of a rotary damper of a hammer receiver.

FIG. 37 illustrates an exploded oblique frontal view of another nonlimiting embodiment of a hammer receiver 170 wherein a pivot point between a first housing segment 196 and a second housing segment 197 may instead be effectuated by a rotary damper 315. The rotary damper 315 may be screwed into a hammer receiver 170 with a plurality of screws 340. The first housing segment 196 may rotationally pivot with respect to the second housing segment 197. The rotary damper 315 may absorb and slow down the rotation of the first housing segment 196 and the second housing segment 197 about the pivot point, dampening vibrations in the adapter handle 100. The rotary damper 315 in this embodiment may also be viewed from cross-sectional top views in FIGS. 38 and 39. Particularly, FIG. 39 provides a closer view of how the rotary damper 315 effectuates a pivot point between the first housing segment 196 and the second housing segment 197.

Figure 40:
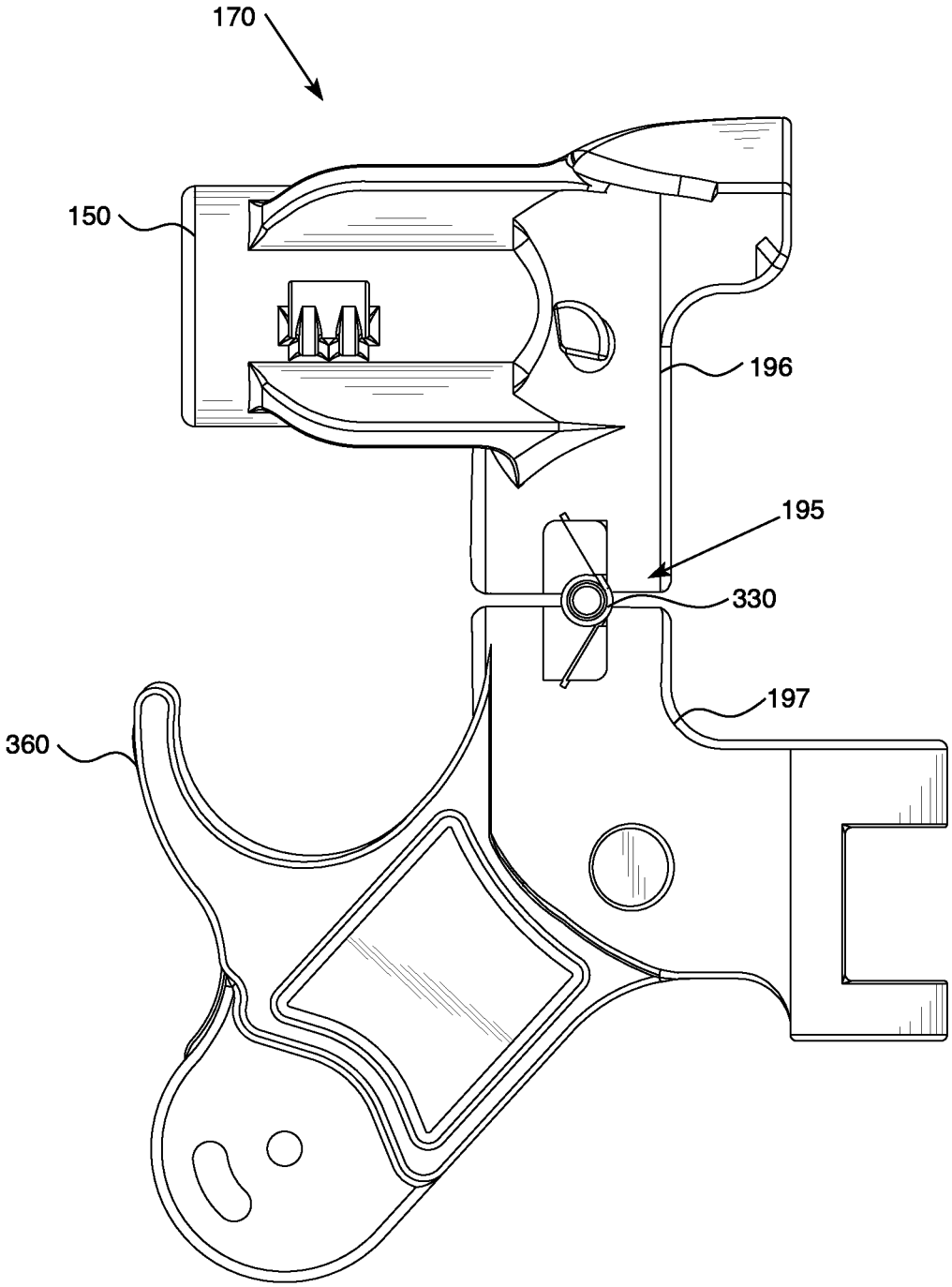
Figure 41:
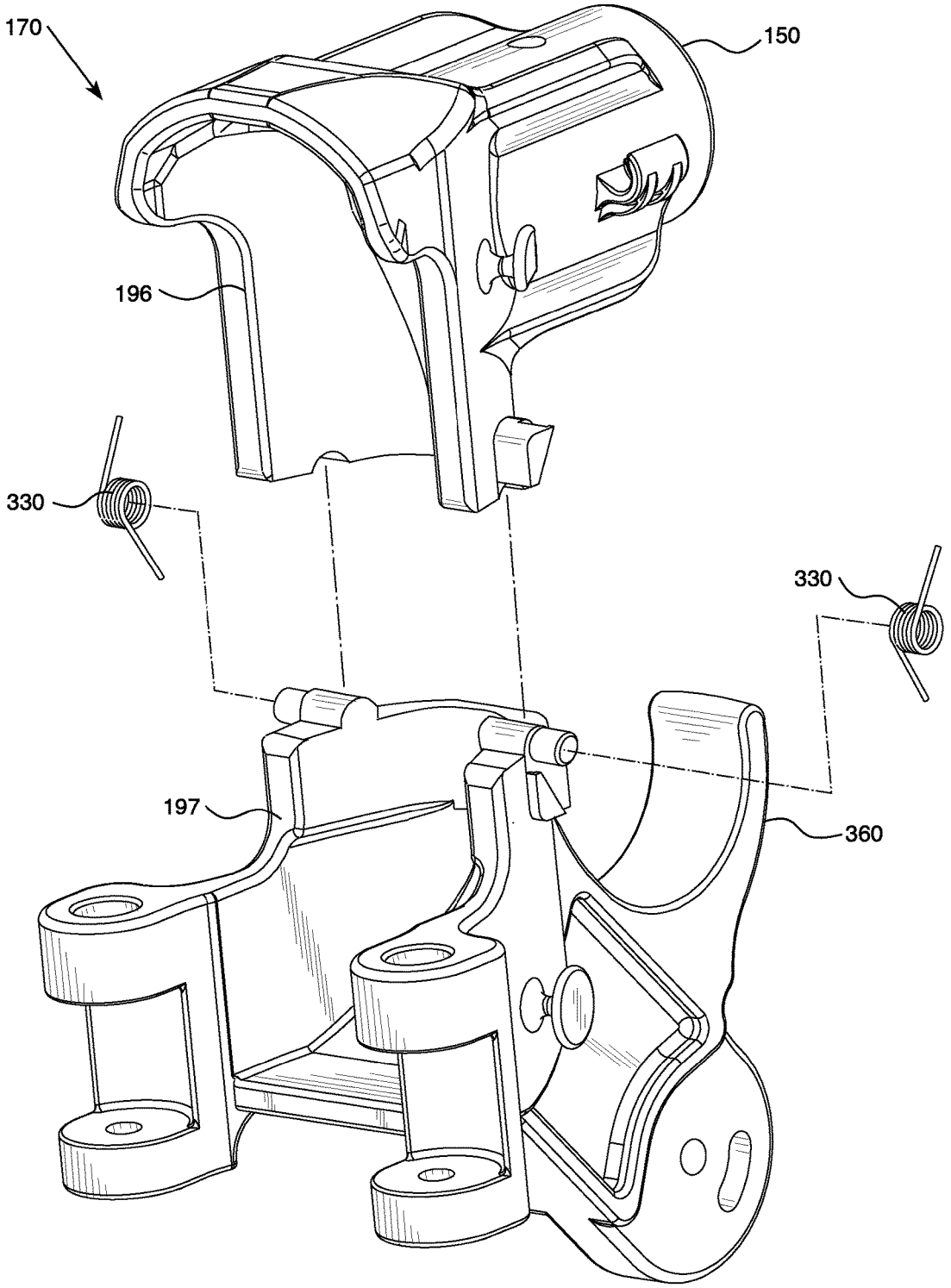

FIG. 41 illustrates an exploded oblique frontal view of another nonlimiting embodiment of a hammer receiver 170 wherein a pivot point between a first housing segment 196 and a second housing segment 197 may instead be effectuated by a tensile spring 330. The first housing segment 196 may rotationally pivot with respect to the second housing segment 197, dampening vibrations in the adapter handle 100. The tensile spring 330 in this embodiment may be further viewed from a side view in FIG. 40. Moreover, FIG. 40 illustrates how the elements of this exploded view may appear upon assembly.

FIG. 22 illustrates an oblique rear view of a hammer receiver 170. This figure particularly illustrates how a hammer receiver 170 wherein a first housing segment 196 is coupled to a second housing segment 197 about a pivot point effectuated by a ball bearing 300 may further comprise a spring retainer 305. The spring retainer 305 is secured to the hammer receiver 170 by a plurality of screws 340. The inclusion of the spring retainer 305 in this embodiment further dampens vibrations in the adapter handle 100. The elements of this embodiment may be further viewed in an exploded view in FIG. 23.

FIG. 23 illustrates an exploded oblique rear view of a hammer receiver 170. This figure particularly illustrates the hollow substantially cylindrical channel 175 which the shaft receiver 150 comprises. This exploded view further illustrates how a first housing segment 196 may be coupled to a second housing segment 197 about a pivot point with a ball bearing 300 and a spring retainer 305. This view is an exploded view of the same embodiment of a hammer receiver 170 as is illustrated in FIG. 22.

In the foregoing specification, the invention has been described with reference to specific exemplary embodiments. Various modifications and changes may be made, however, without departing from the scope of the present invention as set forth in the claims. The specification and figures are illustrative, not restrictive, and modifications are intended to be included within the scope of the present invention. Accordingly, the scope of the invention should be determined by the claims and their legal equivalents rather than by merely the examples described.

For example, the steps recited in any method or process claim may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages, and solutions to problems have been described above with regard to particular embodiments. Any benefit, advantage, solution to problem, or any element that may cause any particular benefit, advantage, or solution to occur or to become more pronounced are not to be construed as critical, required, or essential features or components of any or all the claims.

The terms "comprise", "comprises", "comprising", "having", "including", "includes" or any variations of such terms, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials, or components used in the practice of the present invention, in addition to those not specifically recited, may be varied or otherwise particularly adapted to specific environments, manufacturing specifications, design parameters, or other operating requirements without departing from the general principles of the same.

The invention claimed is:

1. An adapter handle for a chipping hammer comprising:
an elongated shaft having a first end and a second end;
an end grip coupled to the first end of the elongated shaft;
a hammer receiver comprising a hammer handle housing configured to receive a chipping hammer handle, the hammer handle housing having a first housing segment coupled to a second housing segment about a pivot point, the first housing segment further coupled to the second end of the elongated shaft;
a shaft receiver comprising a hollow substantially cylindrical channel having a first end and a second end wherein the first end is coupled to the first housing segment of the hammer handle housing and the second end comprises a receiver opening that is configured to receive the second end of the elongated shaft;
a first secure arm, having a first end and a second end, coupled to the hammer receiver to secure the chipping hammer;
a vacuum hose guide comprising a substantially concave cradle, coupled to one of the elongated shaft and the hammer receiver, configured to secure a vacuum hose; and
a knee guard coupled to the hammer receiver.

2. The adapter handle of claim 1, wherein:
the elongated shaft is telescopic comprising an outer portion at the first end having a plurality of shaft openings and an inner portion at the second end having two lock openings; and
the adapter handle further comprises a locking pin configured to pass through two openings from among the plurality of shaft openings and the two lock openings.

3. The adapter handle of claim 1, further comprising a mid-grip extending substantially perpendicularly from an outer portion of the elongated shaft.

4. The adapter handle of claim 1, wherein the end grip is formed by coupling a substantially perpendicular member to the first end of the elongated shaft, thereby creating a T-shaped handle.

5. The adapter handle of claim 1, wherein:
the hollow substantially cylindrical channel of the shaft receiver further comprises two receiver shaft pin openings;
the second end of the elongated shaft further comprises two shaft pin openings; and
the hammer receiver further comprises a shaft pin that is configured to pass through the two receiver shaft pin openings and the two shaft pin openings to further secure the hammer receiver to the elongated shaft.

6. The adapter handle of claim 1, wherein:
the hammer receiver further comprises a mount having a mount opening;
the knee guard further comprises a clevis having a first knee guard opening and a plurality of supports coupled to the clevis;
the knee guard further comprises a securing pin that is configured to pass through the mount opening and the first knee guard opening to secure the knee guard and to allow the knee guard to pivot about an axis of the securing pin.

7. The adapter handle of claim 6, wherein:
a guide channel is disposed within the mount;
the knee guard further comprises a second knee guard opening; and the knee guard further comprises a restriction pin that is configured to pass through the second knee guard opening and the guide channel to restrict the pivotal range of the knee guard.

8. The adapter handle of claim 1, wherein the first end of the first secure arm is rotatably coupled to the hammer receiver.

9. The adapter handle of claim 1, further comprising:

a locking latch coupled to the second end of the first secure arm;

a second secure arm, having a first end and a second end, the first end of the second secure arm rotatably coupled to the hammer receiver; and a lock anchor coupled to the second end of the second secure arm.

10. The adapter handle of claim 1, wherein the hammer receiver further comprises a cable guide that directs a chipping hammer power cable from the chipping hammer alongside the elongated shaft.

11. The adapter handle of claim 1, wherein the pivot point is effectuated by a ball bearing, spring, rotary damper, rubber grommet, or rubber plate.

12. The adapter handle of claim 11, wherein the pivot point is effectuated by a spring which further comprises a leaf spring, tensile spring, or torsion spring.

13. The adapter handle of claim 11, wherein the pivot point is effectuated by a ball bearing which further comprises a ball bearing with a spring retainer.

14. An adapter handle for a chipping hammer comprising:

an elongated shaft having a first end and a second end;

an end grip coupled to the first end of the elongated shaft;

a hammer receiver coupled to the second end of the elongated shaft, the hammer receiver comprising a hammer handle housing configured to receive a chipping hammer handle;

a shaft receiver, coupled to the hammer handle housing, comprising a hollow substantially cylindrical channel having a first end and a second end wherein the first end is coupled to the hammer handle housing and the second end comprises a receiver opening that is configured to receive the second end of the elongated shaft;

a first secure arm, having a first end and a second end, coupled to the hammer receiver to secure the chipping hammer;

a vacuum hose guide comprising a substantially concave cradle, coupled to one of the elongated shaft and the hammer receiver, configured to secure a vacuum hose; and a knee guard coupled to the hammer receiver; and wherein the adapter handle is comprised of at least one of a nylon, a plastic, a molded rubber, a machined rubber, and a urethane to dampen vibrations.

15. A method of tile removal comprising:

coupling an adapter handle to a chipping hammer, the adapter handle comprising:

an elongated shaft having a first end and a second end;

an end grip coupled to the first end of the elongated shaft;

a hammer receiver comprising a hammer handle housing configured to receive a chipping hammer handle, the hammer handle housing having a first housing segment coupled to a second housing segment about a pivot point, the first housing segment further coupled to the second end of the elongated shaft;

a shaft receiver comprising a hollow substantially cylindrical channel having a first end and a second end wherein the first end is coupled to the first housing segment of the hammer handle housing and the second end comprises a receiver opening that is configured to receive the second end of the elongated shaft;

a first secure arm, having a first end and a second end, coupled to the hammer receiver to secure the chipping hammer;

a vacuum hose guide comprising a substantially concave cradle, coupled to one of the elongated shaft and the hammer receiver, configured to secure a vacuum hose; and a knee guard coupled to the hammer receiver;

gripping the end grip of the adapter handle; and moving the end grip such that the coupled chipping hammer traverses a tiled surface, the blade of the chipping hammer contacting the tiled surface, thereby removing tile.

16. The method of tile removal from claim 15, further comprising exerting pressure on the knee guard to apply additional force to the adapter handle, thereby removing tile more effectively.

17. The method of tile removal from claim 15, further comprising adjusting a height of the adapter handle by adjusting a length of the elongated shaft and wherein the elongated shaft is telescoping.

18. The method of tile removal from claim 15, wherein the adapter handle is gripped from a standing position.

19. The method of tile removal from claim 15, further comprising gripping a mid-grip for increased control of the adapter handle.

* * * * *